US005238797A

United States Patent [19]

Hirabayashi et al.

[11] Patent Number: 5,238,797

[45] Date of Patent: Aug. 24, 1993

[54] SILVER HALIDE COLOR PHOTOGRAPHIC LIGHT-SENSITIVE MATERIAL CONTAINING A 1-PENTAHALOGENOPHENYL-SUBSTITUTED 5-PYRAZOLONE COLORED MAGENTA COUPLER

[75] Inventors: Shigeto Hirabayashi; Shuichi Sugita; Katsumasa Yamazaki, all of Tokyo, Japan

[73] Assignee: Konica Corporation, Tokyo, Japan

[21] Appl. No.: 911,045

[22] Filed: Jul. 9, 1992

[30] Foreign Application Priority Data

Aug. 26, 1991 [JP] Japan ..... 3-236874

[51] Int. Cl.[5] ..... G03C 1/08

[52] U.S. Cl. ..... 430/508; 430/504; 430/555; 430/359; 430/507; 430/522; 430/561; 430/580; 430/588

[58] Field of Search ..... 430/504, 555, 359, 507, 430/522, 561, 580, 508, 588

[56] References Cited

U.S. PATENT DOCUMENTS

| | | | |
|---|---|---|---|
| 1,044,778 | 11/1912 | Gruttefien | 564/361 |
| 1,846,302 | 2/1932 | Brooker | 430/588 |
| 2,072,908 | 3/1937 | Schneider | 548/219 |
| 2,112,140 | 3/1938 | Brooker et al. | 548/121 |
| 2,336,843 | 12/1943 | Brooker et al. | 548/156 |
| 2,369,646 | 2/1945 | Brooker et al. | 548/150 |
| 2,385,815 | 10/1945 | Kendall et al. | 546/175 |
| 2,415,927 | 2/1947 | Anish | 430/578 |

(List continued on next page.)

FOREIGN PATENT DOCUMENTS

| | | |
|---|---|---|
| 0271063 | 6/1988 | European Pat. Off. . |
| 0345839 | 12/1989 | European Pat. Off. . |
| 2336711 | 7/1977 | France . |
| 36-21711 | 3/1961 | Japan . |
| 49-123625 | 11/1974 | Japan . |
| 49-131448 | 12/1974 | Japan . |

(List continued on next page.)

*Primary Examiner*—Charles L. Bowers, Jr.
*Assistant Examiner*—Geraldine Letscher
*Attorney, Agent, or Firm*—Finnegan, Henderson, Farabow, Garrett & Dunner

[57] ABSTRACT

Disclosed is a silver halide color photographic light sensitive material comprising a support having thereon a blue-sensitive silver halide emulsion layer, a green-sensitive silver halide emulsion layer and a red-sensitive silver halide emulsion layer, wherein at least one of green-sensitive silver halide emulsion layers contains at least one of colored magenta couplers represented by Formula CM-1 and at least one of dyes having absorption maximum at 590 nm to 610 nm is contained in at least one of layers selected from the layers consisting of silver halide emulsion layers and photographic constitution layers;

Formula CM-1 wherein $R_1$ represents a substituent, $R_2$ represents an acylamino group, a sulfonamide group, an imide group, a carbamoyl group, a sulfamoyl group, an alkoxyl group, an alkoxycarbonyl group, an alkoxycarbonylamino group, $R_3$ represents a halogen atom, an alkoxy group, m is an integer of 0 to 5, n is an integer of 0 to 4.

A silver halide color photographic light-sensitive material is improved in a sharpness and color reproducibility and fogging and speed and fluctuation.

4 Claims, No Drawings

U.S. PATENT DOCUMENTS

| | | | |
|---|---|---|---|
| 2,428,054 | 9/1947 | Vittum et al. | 430/359 |
| 2,429,574 | 10/1947 | Anish et al. | 548/147 |
| 2,449,966 | 9/1948 | Hanson, Jr. | 430/359 |
| 2,478,366 | 8/1949 | Brooker et al. | 548/121 |
| 2,481,464 | 9/1949 | Anish | 430/587 |
| 2,484,536 | 10/1949 | Van de Straete | 548/121 |
| 2,485,679 | 10/1949 | Van Zandt | 548/152 |
| 2,515,913 | 7/1950 | Van Zandt | 548/152 |
| 2,521,705 | 9/1950 | Firestine | 548/219 |
| 2,647,050 | 7/1953 | Firestine | 430/588 |
| 2,647,051 | 7/1953 | Vinton et al. | 430/588 |
| 2,647,052 | 7/1953 | Martin | 430/588 |
| 2,647,053 | 7/1953 | Vinton | 430/588 |
| 2,763,552 | 9/1956 | Van Campen et al. | 430/545 |
| 2,983,608 | 9/1961 | Beavers | 430/555 |
| 3,282,932 | 11/1966 | Lincoln et al. | 544/300 |
| 3,384,489 | 9/1968 | Lincoln et al. | 430/570 |
| 3,469,987 | 9/1969 | Owens et al. | 430/580 |
| 3,476,564 | 11/1969 | Mariani | 430/555 |
| 3,519,429 | 7/1970 | Lestina | 430/551 |
| 3,615,506 | 10/1971 | Abbott et al. | 430/381 |
| 3,615,644 | 10/1971 | Gotze et al. | 430/321 |
| 3,653,905 | 4/1972 | Depoorter et al. | 430/522 |
| 3,676,147 | 7/1972 | Boyer et al. | 430/569 |
| 3,705,035 | 12/1972 | Vetter et al. | 430/239 |
| 3,705,869 | 12/1972 | Darmory et al. | 524/104 |
| 3,822,135 | 7/1974 | Sakai et al. | 430/570 |
| 4,247,627 | 1/1981 | Chen | 430/512 |
| 4,515,888 | 5/1985 | Beretta et al. | 430/584 |
| 4,740,455 | 4/1988 | Kubodera et al. | 430/617 |
| 4,788,284 | 11/1988 | Masukawa et al. | 544/139 |
| 4,992,357 | 2/1991 | Haga et al. | 430/504 |
| 5,091,293 | 2/1992 | Nozawa et al. | 430/503 |

FOREIGN PATENT DOCUMENTS

| | | |
|---|---|---|
| 50-11419 | 2/1975 | Japan . |
| 50-80826 | 7/1975 | Japan . |
| 50-80827 | 7/1975 | Japan . |
| 50-40659 | 12/1975 | Japan . |
| 51-59942 | 5/1976 | Japan . |
| 52-42121 | 4/1977 | Japan . |
| 52-102723 | 8/1977 | Japan . |
| 53-16624 | 2/1978 | Japan . |
| 53-63016 | 6/1978 | Japan . |
| 53-102732 | 9/1978 | Japan . |
| 53-137131 | 11/1978 | Japan . |
| 54-52532 | 4/1979 | Japan . |
| 59-148053 | 8/1984 | Japan . |
| 60-32851 | 2/1985 | Japan . |
| 60-186567 | 9/1985 | Japan . |
| 60-213937 | 10/1985 | Japan . |
| 62-174740 | 7/1987 | Japan . |
| 62-223748 | 10/1987 | Japan . |
| 63-113077 | 5/1988 | Japan . |
| 64-3658 | 1/1989 | Japan . |
| 64-26853 | 1/1989 | Japan . |
| 64-28638 | 1/1989 | Japan . |
| 64-32260 | 2/1989 | Japan . |
| 64-46753 | 2/1989 | Japan . |
| 64-48862 | 2/1989 | Japan . |
| 64-48863 | 2/1989 | Japan . |
| 1-105250 | 4/1989 | Japan . |
| 1-105251 | 4/1989 | Japan . |
| 2-135437 | 5/1990 | Japan . |
| 2-135438 | 5/1990 | Japan . |
| 49381 | 1/1992 | Japan . |
| 1552701 | 9/1979 | United Kingdom . |

SILVER HALIDE COLOR PHOTOGRAPHIC LIGHT-SENSITIVE MATERIAL CONTAINING A 1-PENTAHALOGENOPHENYL-SUBSTITUTED 5-PYRAZOLONE COLORED MAGENTA COUPLER

FIELD OF THE INVENTION

The present invention relates to a silver halide color photographic light-sensitive material, more particularly, to a silver halide color photographic light-sensitive material having high sharpness, preferable color reproducibility, high speed with less fogging and less fluctuation among printers.

BACKGROUND OF THE INVENTION

In color photographic light-sensitive materials, dyes of yellow, magenta and cyan formed from couplers do not necessarily have ideal absorption characteristics. For example, it is normal that a magenta dye image absorbs more or less blue light in addition to the necessary absorption of green light, causing distortion in color reproducibility. In order to eliminate the above-mentioned distortion of color reproducibility, couplers colored with yellow or magenta are used before conducting coupling reaction with the oxidation product of aromatic primary amine color developer. The former coupler is so-called a colored magenta coupler and the latter coupler is so-called a colored cyan coupler.

The above-mentioned Auto-masking method employing colored couplers has been described in detail in J. Phot. Soc. Am., 13,94 (1947), J. Opt. Soc. Am., 40,166 (1950) or J. Am. Chem. Soc., 72,1533 (1950).

As colored magenta couplers having a main absorption in blue light area, 1-phenyl-3-acylamino-4-phenylazo-5-pyrazolone is described in U.S. Pat. Nos. 2,428,054 and 2,449,966, those having 4-methoxyarylazo group are described in U.S. Pat. No. 2,763,552, 1-phenyl-3-anilino-4-phenylazo-5-pyrazolone is described in U.S. Pat. No. 2,983,608, those having a naphthylazo group are described in U.S. Pat. Nos. 3,519,429 and 3,615,506, those having a water-soluble group are described in U.S. Pat. No. 1,044,778, those having a hydroxyphenylazo group are described in U.S. Pat. No. 3,476,564 and Japanese Patent Publication Open to Public Inspection (hereinafter referred to as Japanese Patent O.P.I. Publication) Nos. 123625/1974, 131448/1974 and 52532/1979, those having acylaminophenylazo group were described in Japanese Patent O.P.I. Publication No. 42121/1977, those having a substituted alkoxyphenylazo group are described in Japanese Patent O.P.I. Publication No. 102723/1977 and those having a thiophenylazo group are described in Japanese Patent O.P.I. Publication No. 63016/1978.

However, the above-mentioned colored magenta couplers are not satisfactorily preferable because they need large amounts of addition due to their small mol absorption coefficient, it is difficult to adjust the main absorption to preferable areas, the masking effect is small due to low development activity, fogging is easy to occur while the development activity is high, stability on light, heat and humidity is low and magenta dyes created through the reaction of color developing agent are for short wavelength. It is the present status, therefore, that the performance is maintained with difficulty by combining some kinds of colored magenta couplers. Especially recently, employment of high speed fine grain silver halide emulsions and high color-developing magenta couplers has required colored magenta couplers to have higher performance.

Recently, in particular, it turned out that, when a color paper is printed from a color negative film, disparity occurs on hue of the finished color print due to the difference of the model of an instrument used for printing (hereinafter called a printer) and it became apparent that one of the causes was the image toner of color-developing dye obtained from colored magenta couplers used for a color negative film.

With regard to the fluctuation between printers, remarkable improvement are observed when using the colored magenta couplers described in Japanese Patent Application No. 122400/1990. However, they still are not on a satisfactory level.

In addition, together with change light-sensitive material for photographic use to small format and prevailing of panorama print (a picture is photographed at the central portion of 35 milli film oblongly and to print its photographed portion panoramically), photographic light-sensitive materials having high sharpness and high image quality are demanded.

On the other hand, it is known that some kinds of polymethine dyes are extremely effective as a means for spectrally sensitizing silver halide emulsions. For example, many types of compounds are described in pp. 194 to 234 of *The Theory of the Photographic Process* 4th edition written by T. H. James. For the above-mentioned sensitizing dyes, it is requested to satisfy the following conditions in addition to extending the area of light-sensitive wavelength of silver halide emulsion.

1) Spectral sensitization by means of dye sensitization is appropriate.
2) Sensitization efficiency is so high that completely high sensitivity can be provided.
3) The occurrence of fogging is not involved.
4) There is no adverse interaction with other additives, for example, stabilizers, anti-foggants, couplers, DP' scavengers and coating aids.
5) Desorption of dyes and the decrease of sensitivity are not caused when silver halide coating emulsions containing sensitizing dyes are left for a long time.
6) Increase of fog density and decrease of sensitivity are not caused when silver halide light-sensitive materials containing sensitizing dyes are left for a long time under high temperature and high humidity.
7) Added sensitizing dyes do not diffuse to the other light-sensitive layers to cause color contamination after development processing.

Various compounds have been proposed and synthesized in order to satisfy many conditions having important meaning when the above-mentioned silver halide emulsions are prepared. Among others, an azol ring trimethine cyanine dyes having a chalcogen atom inside the ring such as thiacarbocyanine, oxathiacarbocyanine, selenacarbocyanine and oxaselenacarbocyanine are known as main red sensitizers because they have preferable spectral in the red color area and they are excellent in spectral sensitization efficiency. Namely, for example, cyanine dyes substituting alkoxy groups described in U.S. Pat. No. 3,615,644 on the condensed ring, thiacarbocyanine dyes substituting methylenedioxy groups described in U.S. Pat. No. 2,429,574, thiacarbocyanine dyes substituting phenyl groups at 5th position described in U.S. Pat. No. 2,515,913, thiacarbocyanine dyes substituting carboxy groups at 5th position described in U.S. Pat. No. 2,647,050, thiacarbocyanine dyes substituted alkoxycarbonyl groups at 5th position described in U.S. Pat. Nos. 2,647,051 and 2,647,052, carbocyanine dyes substituted phenyl groups at 6th position described in U.S. Pat. No. 2,485,679, saturated carbon ring condensed thiazolocarbocyanine dyes described in U.S. Pat. No. 2,336,843, other carbocyanine dyes described in U.S. Pat. Nos. 1,846,302, 2,112,140 and 2,481,464, trimethine dyes having a substituent on a methine carbon atom described in U.S. Pat. Nos. 2,369,646, 2,385,815, 2,484,536, 2,415,927, 2,478,366, 2,739,964, 3,282,932 and 3,384,489 and trimethinecyanine dyes substituting anion groups described in U.S. Pat. Nos. 2,647,053, 2,521,705 and 2,072,908 and British Patent No. 654,690 and Japanese Patent Publication No. 21711/1961 are cited. Though some of the above-mentioned carbocyanine dyes are used singly and the others are used in combination with other plural dyes to obtain satisfactorily level, it has become apparent that contamination caused by the remaining of spectral sensitizing dyes in the light-sensitive materials after being subjected to development processing (hereinafter referred to as color-remaining contamination) is the factor of the above-mentioned fluctuation between printers. And, at that point, it has become apparent that conventional carbocyanine dyes are on the level that is extremely unsatisfactory.

SUMMARY OF THE INVENTION

The object of the present invention is to provide a silver halide color photographic light-sensitive material having high speed, less fogging and less fluctuation between printers.

DETAILED DESCRIPTION OF THE PREFERRED EMBODIMENT

The above-mentioned object of the present invention is attained by the following silver halide color photographic light-sensitive material.

(1) A silver halide color photographic light-sensitive material comprising a support having thereon a blue sensitive silver halide emulsion layer, a green sensitive silver halide emulsion layer and a red sensitive silver halide emulsion layer wherein at least one of colored magenta couplers represented by the following Formula CM-I is contained in at least one green sensitive silver halide emulsion layer and at least one of dyes having absorption maximum at 590 nm to 610 nm is contained in at lest one of silver halide emulsion layers and/or photographic constitution layers.

(2) A silver halide color photographic light-sensitive material comprising a support having thereon a blue sensitive silver halide emulsion layer, a green sensitive silver halide emulsion layer and a red sensitive silver halide emulsion layer wherein at least one of colored magenta couplers represented by the following Formula CM-I is contained in at least one of green sensitive silver halide emulsion layer and at least one of spectral sensitizing dyes represented by the following Formula S-I is contained in at least one of silver halide emulsion layers.

Formula CM-1

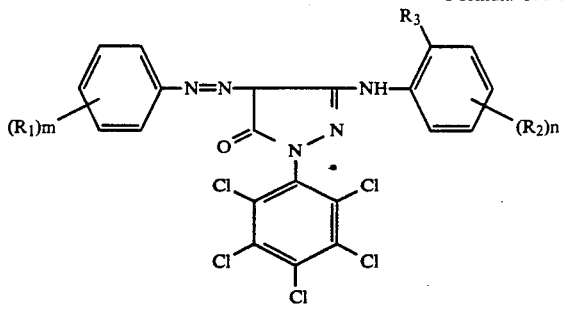

wherein $R_1$ represents a substituent; $R_2$ represents an acylamino group, a sulfonamide group, an imide group, a carbamoyl group, a sulfamoyl group, an alkoxy group, an alkoxycarbonyl group of an alkoxycarbonylamino group; $R_3$ represents a halogen atom or an alkoxy group; m represents 0 to 5 and n represents 0 to 4 integers.

Formula S-I

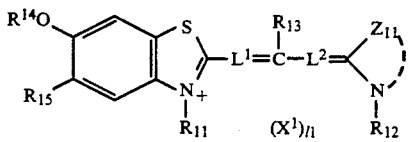

wherein $R_{11}$ and $R_{12}$ represent an alkyl group having not less than 1 and not more than 10 carbons or an alkenyl group having not less than 3 and not more than 10 carbons respectively; $R_{13}$ represents a hydrogen atom, a heterocyclic group, an aryl group or an alkyl group; $R_{14}$ and $R_{15}$ represent an alkyl group respectively; $Z_{11}$ represents nonmetallic atoms necessary for forming a 5-membered monocyclic or condensed 5-membered nitrogen-containing heterocycle. $L^1$ and $L^2$ represent a methine group respectively; $R_{11}$ and $L^1$ or $R_{12}$ and $L^2$ may each joined to form 5- membered or 6-membered heterocycle; $X^1$ represents an ion cancelling electric charges inside molecules; $l^1$ represents the number of ions necessary for cancelling electric charges inside molecules; when the compound form an intramalecular salt. $l^1$ represents 0.

Hereinafter, we will explain the present invention in detail.

At first, we will explain colored magenta couplers represented by Formula CM-I.

As substituents represented by $R_1$ in Formula CM-I, for example, an alkyl group, an alkoxy group, an aryl group, an acylamino group, a sulfonamide group, a hydroxyl group, a halogen group, an alkoxycarbonyl group, an acyl group, a carbamoyl group, a sulfamoyl group and a carboxyl group are cited. These groups may have a substituent in addition. $R_1$ represents preferably an alkyl group, an alkoxyl group, a hydroxyl group or an acylamino group. It represents most preferably an alkoxyl group.

As acylamino groups represented by $R_2$, for example, a 2,4-t-pentylphenoxyacetoamide group and a 4-(2,4-di-t-pentylphenoxy)butane amide group are cited. As sulfonamide groups, for example, a 4-dodecyloxyphenylsulfonamide group is cited. As carbamoyl group, for example, a 4-(2,4-di-t-pentylphenoxy)butylamino carbonyl group is cited. As a sulfamoyl groups, for example, a tetradecanesulfamoyl group is cited. As an alkoxyl group, for example, a methoxy group, an ethoxy group and an octyloxy group are cited. As an alkoxycarbonyl group, for example, a tetradecaneoxycarbonyl group is cited. In addition, as alkoxycarbonylamino groups, for example, a dodecyloxycarbonylamino group is cited. As $R_2$, the preferable is an acylamino group substituting at p-position for $R_3$.

As halogen atoms represented by $R_3$, for example, a chlorine atom, a bromine atom and a fluorine atom are cited. In addition, as alkoxyl groups, for example, a methoxy group and a dodecyloxy group are cited. As $R_3$, the preferable is a chlorine atom. In addition, m is preferably 1 or 2, n is 1.

Hereunder, practical examples of compounds represented by the above-mentioned Formula CM-1 in the present invention are illustrated.

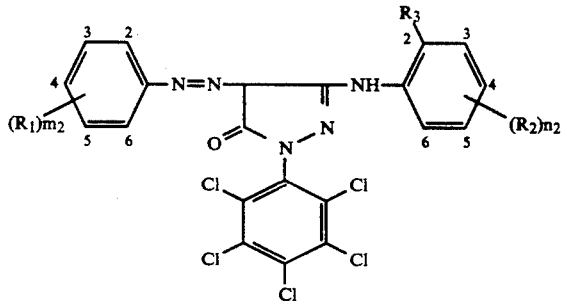

| Compounds | $(R_1)\ m_2$ | $(R_2)\ n_2$ | $R_3$ |
|---|---|---|---|
| CM-1 | 3-$OCH_3$, 4-$OCH_3$ | 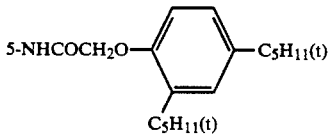 | —Cl |
| CM-2 | 3-$OCH_3$, 4-$OCH_3$ | 5-$NHCOC_{13}H_{27}$ | —Cl |
| CM-3 | 3-$OCH_3$, 4-$OCH_3$ | 4-$NHSO_2C_{16}H_{27}$ | —Cl |
| CM-4 | 3-$OCH_3$, 4-$OCH_3$ | 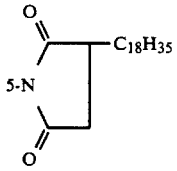 | —Cl |
| CM-5 | 3-$OCH_3$, 4-$OCH_3$ | 5-$NHSO_2C_{16}H_{33}$ | —Cl |
| CM-6 | 3-$OCH_3$, 4-$OCH_3$ | 5-$CONHC_{14}H_{29}$ | —Cl |
| CM-7 | 3-$OC_2H_5$, 4-$OC_2H_5$ | 5-$NHCOC_{13}H_{27}$ | —Cl |
| CM-8 | 3-$OC_2H_5$, 4-$OC_2H_5$ | 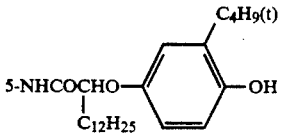 | —Cl |
| CM-9 | 3-$OC_2H_5$, 4-$OC_2H_5$ | 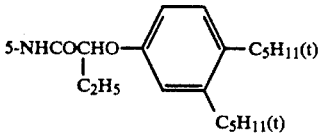 | —Cl |
| CM-10 | 3-$OC_2H_5$, 4-$OC_2H_5$ | 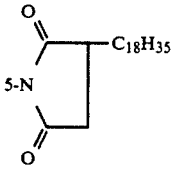 | —Cl |

-continued
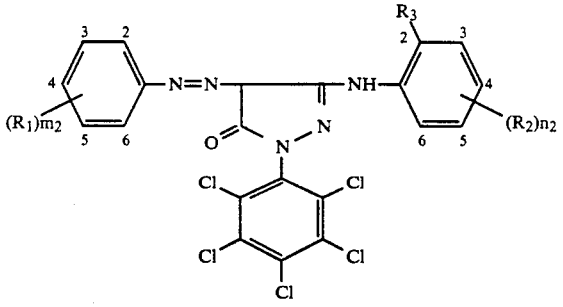
| Compounds | $(R_1)\ m_2$ | $(R_2)\ n_2$ | $R_3$ |
|---|---|---|---|
| CM-11 | 3-$OC_2H_5$, 4-$OC_2H_5$ | 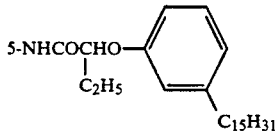 | —Cl |
| CM-12 | 4-$OCH_3$ | 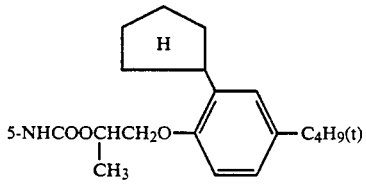 | —Cl |
| CM-13 | 4-$OCH_3$ | 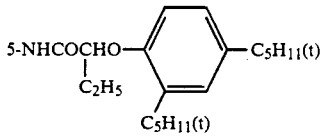 | —Cl |
| CM-14 | 4-$OCH_3$ | -($n_2$=O) | —$OC_{12}H_{25}$ |
| CM-15 | 3-$CH_3$, 4-OH | 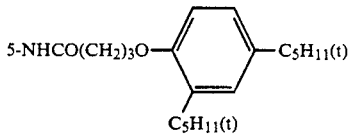 | —Cl |
| CM-16 | 3-$CH_3$, 4-OH | 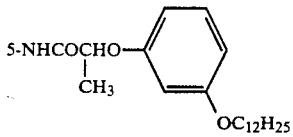 | —Cl |
| CM-17 | 4-OH | 5-$NHCOOC_{16}H_{33}$ | —Cl |
| CM-18 | 4-OH | 4-$OC_8H_{17}$, 5-$OC_8H_{17}$ | —Cl |
| CM-19 | 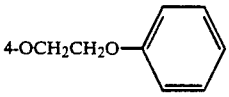 | 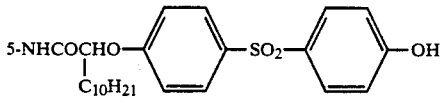 | —$OCH_3$ |
| CM-20 | 4-$NHCOC_4H_9$(t) | 4-$NHCOC_{13}H_{27}$ | —Cl |
| CM-21 | 4-$NHCOC_4H_9$(t) | 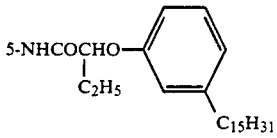 | —Cl |
| CM-22 | 3-$C_3H_7$(i), 4-$C_3H_7$(i) | 5-$COOC_{12}H_{25}$ | —Cl |
| CM-23 | 3-$C_3H_7$(i), 4-$C_3H_7$(i) | 4-$SO_2N(C_8H_{17})_2$ | —F |

-continued
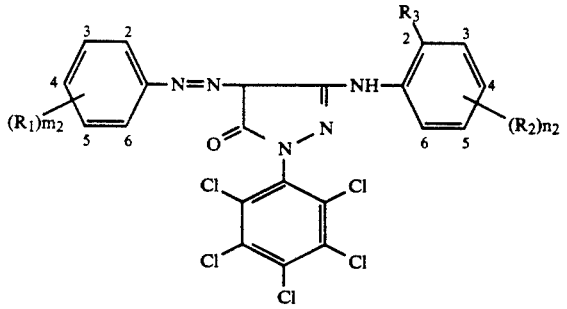
| Compounds | $(R_1)\ m_2$ | $(R_2)\ n_2$ | $R_3$ |
|---|---|---|---|
| CM-24 | 3-$OCH_3$, 4-$OCH_3$ | 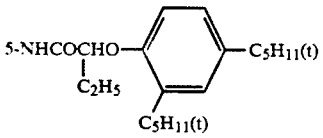 | —Cl |
| CM-25 | 3-$OC_2H_5$, 4-$OC_2H_5$ | 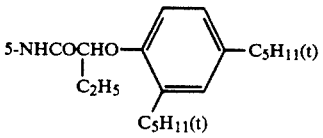 | —Cl |
| CM-26 | 4-$OC_2H_5$ | 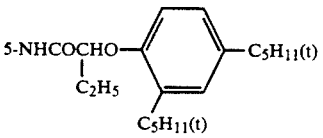 | —Cl |
| CM-27 | 4-$OC_3H_7$ | 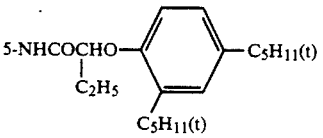 | —Cl |
| CM-28 | 4-$OC_4H_9$ | 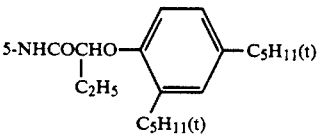 | —Cl |
| CM-29 | 4-$OCH_3$ | 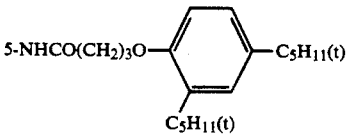 | —Cl |
| CM-30 | 3-$OCH_3$, 4-$OCH_3$ | 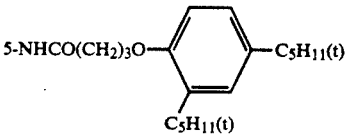 | —Cl |
| CM-31 | 3-$OC_2H_5$, 4-$OC_2H_5$ | 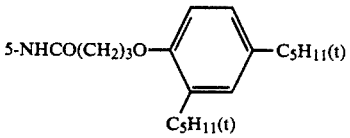 | —Cl |

-continued

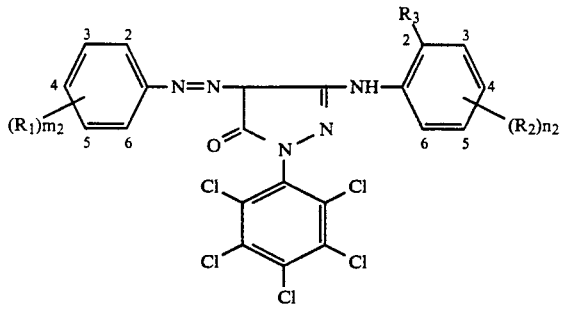

| Compounds | $(R_1)\ m_2$ | $(R_2)\ n_2$ | $R_3$ |
|---|---|---|---|
| CM-32 | 4-$OC_2H_5$ | 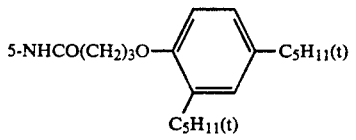 | —Cl |
| CM-33 | 4-$OC_3H_7$ | 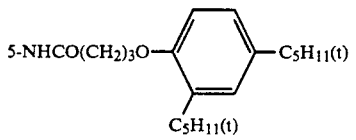 | —Cl |
| CM-34 | 4-$OC_4H_9$ | 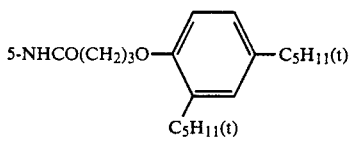 | —Cl |
| CM-35 | 4-$NHCOC_4H_9(t)$ | 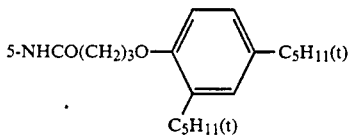 | —Cl |
| CM-36 | 4-OH | 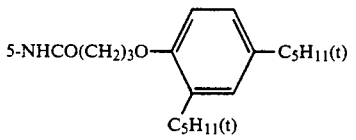 | —Cl |

Colored magenta couplers represented by Formula CM-I in the present invention can normally be synthesized by a conventional so-called diazo-coupling reaction. For example, it can be synthesized by a method described in Japanese Patent Publication No. 6540/1981. Namely, an aniline derivative is subjected to diazotization employing 1 to 5 times mol of concentrated hydrochloric acid and 1 to 1.2 times mol of disodium nitric acid in water, water-containing alcohol or water-containing acetone at 0° to −10° C. When the solution is added to a pyridine solution of magenta coupler prepared separately and having the same mol as the above-mentioned aniline derivative at −5° to −10° C. for diazo-coupling, a colored coupler aimed is prepared.

Next, we will illustrate practical examples of colored magenta coupler represented by Formula CM-I in the present invention.

SYNTHESIS EXAMPLE 1

Synthesis of CM-7

1.4 g of 3,4-diethyoxyaniline was dissolved in 3 ml of concentrated hydrochloric acid and 18 ml of water in heating. Then, the solution was chilled to −3° C. To the solution, 5.3 ml of 10% sodium sulfite aqueous solution was added to be diazotized. After the solution was agitated for 20 seconds at −3° C., 0.1 g of urea was added so that excessive nitrite was decomposed. Separately, 5.2 g of 1-(2,3,4,5,6-pentachlorophenyl)-3-(2-chloro-5-tetradecaneamidoanilino)-5-pyrazolone was dissolved in 100 ml of pyridine. The solution was chilled at −5° to −10° C. to be agitated. To it, the solution of diazonium salt prepared as above was added slowly.

After 3 hours, the reacted solution was poured to 400 ml of iced water containing 100 ml of condensed hydrochloric acid. After the crystals were filtrated, washed with water and dried, they were added to a mixed solution of ethyl acetate and acetonitrile to be crystalized again. Thus, 5.5 g of CM-7 was obtained.

SYNTHESIS EXAMPLE 2

Synthesis of CM-13

1.0 g of 4-methoxyaniline was dissolved in 3 ml of concentrated hydrochloric acid and 20 ml of water in heating. Then, the solution was chilled to −3° C. To the solution, 5.3 ml of 10 % sodium nitrite aqueous solution was added to be diazotized. After the solution was agitated for 20 seconds at −3° C., 0.1 g of urea was added so that excessive nitrous acid was decomposed.

Separately, 5.6 g of 1-(2,3,4,5,6-pentachlorophenyl)-3-{2-chloro-5-[α-(2,4-di-t-amylphenoxy)-butaneamide]anilino}5-pyrazolone was dissolved in 100 ml of pyridine. The solution was chilled to −5° to −10° C., and agitated. The diazonium salt solution prepared as above was added slowly thereto. After 3 hours, the reacted solution was poured into 400 ml of iced water containing 100 ml of condensed hydrochloric acid. After the crystals were filtrated, washed with water and dried, they were added to a mixed solution of acetonitrile and ethyl acetate to be crystalized again. Thus, 5.1 g of CM-13 was obtained.

The structure of the above-mentioned chemicals were identified by means of NMR spectrum and Mass spectrum.

The colored magenta couplers represented by the above-mentioned Formula CM-I in the present invention can be used independently or in combination. Normally, they are used in combination with 2 or more substantially colorless magenta coupler due to the theory of automasking.

Next, we will explain dyes having the absorption maximum at a range from 590 nm to 610 nm.

As dyes having the absorption maximum at the range from 590 nm to 610 nm, those having structures represented by the following Formulas 1 to 9 are preferable.

Formula 1

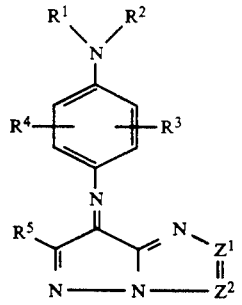

Formula 2

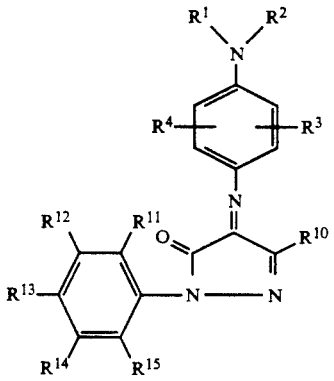

-continued

Formula 3

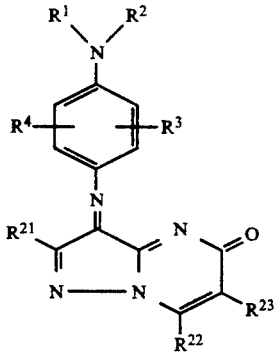

Formula 4

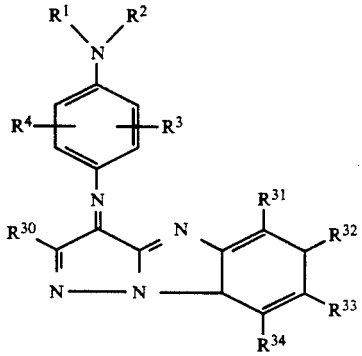

Formula 5

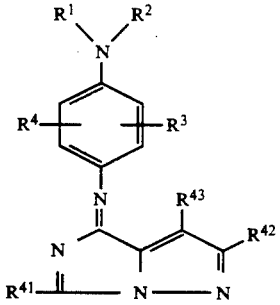

Formula 6

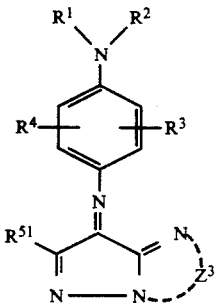

-continued

Formula 7

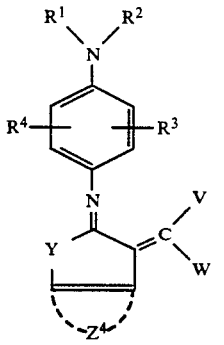

Formula 8

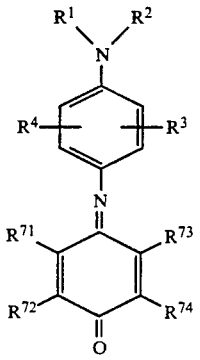

Formula 9

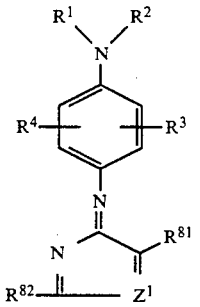

wherein $R^1$ and $R^2$ represent a hydrogen atom, an alkyl group respectively (for example, straight-chained and branch-chained substituent such as a methyl group, an ethyl group, a propyl group, an amyl group, a 2-ethylhexyl group, a dodecyl group, a 2-hexyldecyl group and an octadecyl group or substituted groups such as a 2-carboxyethyl group, a 2-hydroxyethyl group, a 2-methylsulfonylaminoethyl group, a 2-methoxyethyl group, a 4-methoxybutyl group and a 3-sulfopropyl group); $R^3$ and $R^4$ represent a hydrogen atom, an alkyl group (for example, a methyl group, an ethyl group and an i-propyl group), halogen atoms (for example, a fluorine atom, a chlorine atom, a bromine atom and a iodine atom) and an alkoxyl group (for example, a methoxy group, an ethoxy group and a propoxy group);

$Z^1$ and $Z^2$ represent a nitrogen atom or a $=C(R^6)-$ group respectively; $Z^3$ represents a non-metallic atom group necessary for forming a nitrogen-containing 7-membered heterocycle which may have a substituent; $Z^4$ represents nonmetallic atoms necessary for forming a condensed benzene ring; $R^5$, $R^6$, $R^{11}$ to $R^{15}R^{21}$ to $R^{23}$, $R^{31}$ to $R^{34}$, $R^{41}$ to $R^{43}$, $R^{51}$ and $R^{71}$ to $R^{74}$ represent a hydrogen atom or a substituent respectively; as a substituent, halogen atoms (for example, a fluorine atom, a chlorine atom, a bromine atom and an iodine atom), alkyl groups (for example, straight-chained or branch-chained substituent having 1 to 32 carbons including a methyl group, an ethyl group, a propyl group, an i-propyl group, a t-butyl group, an amyl group, a 2-ethylhexyl group, a dodecyl group, a pentadecyl group, a 2-hexyldecyl group, a dodecyl group, a pentadecyl group, a 2-hexyldecyl group and an octadecyl group, ring groups including a cyclopropyl group, a cyclopentyl group and a cyclohexyl group or substituted groups including a trifluoromethyl group, a 2-methanesulfonylethyl group, a 2-(2,4,6-trichlorophenyl)ethyl group, a 2-chlorobutyl-3-(3-pentadecylphenoxy)propyl group, a 2-ethoxytridecyl group, a 3-{4-{2-[4-(4-hydroxyphenylsulfonyl)phenoxy]dodecaneamido}phenyl}propyl group, a 3-(2,4-di-t-amylphenoxy)propyl group, a 3-(4-nitrophenyl)propyl group and a 3-{4-[2-(2,4-diamylphenoxy)hexaneamido]phenyl}propyl group), aryl groups (for example, a phenyl group, a 4-t-butylphenyl group, a 2,4-di-t-amylphenyl group, a 4-nitrophenyl group, a 3-nitropheneyl group, a 4-methanesulfonylphenyl group, a 3-methanesulfonylaminophenyl group, a 2,4,6-trichlorophenyl group, a 4-trifluoromethylphenyl group, a 2-methoxyphenyl group, a 2-acetylaminophenyl group and a 2-(2-ethylureido)phenyl group), heterocyclic groups (for example, a 2-puridyl group, a 2-furyl group, a 2-pyrimidyl group, a 2-thienyl group and a 5-nitro-2-thienyl group), alkoxy groups (for example, a methoxy group, an ethoxy group, a 2-methoxyethoxy group, a 2-methanesulfonylethoxy group and a 2-dodecyloxy group), aryloxy groups (for example, a phenoxy group, a 2-methylphenoxy group and a 4-t-butylphenoxy group), heterocyclic oxy groups (for example, a 1-phenyltetrazole-5-oxy and a 2-tetrahydropyranyloxy group), carbamoyloxy group (for example, an N-methylcarbamoyloxy group and an N-phenylcarbamoyloxy group), silyloxy groups (for example, a trimethylsilyloxy group and a dibutylmethylsilyloxy group), alkylthio groups (for example, a methyl thio group, an octyl thio group, a tetradecyl thio group, an octadecyl thio group, a 3-phenoxypropyl thio group and a 3-(4-t-butylphenoxy)propyl group), arylthio groups (for example, a phenylthio group, a 2-buthoxy-5-t-octylphenyl thio group, a 3-pentadecylphenyl thio group, a 2-carboxyphenyl thio group and a 4-tetradecaneamidophenyl thio group), heterocyclicthio group (for example, a 2-benzothiazolylthio, a 2,4-diphenoxy-1,3,5-triazole-6-thio group and a 2-pyridylthio group), acylamino groups (for example, an octamide group, a tetradecaneamide group, a 2-(2,4-di-t-amylphenoxy)butaneamide, 4-(3-t-butyl-4-hydroxyphenoxy)butaneamide, a 2-{4-(4-hydroxyphenylsulfonyl group)phenoxy}decaneamide group and a benzamide group), amino groups (for example, an anilino group, a 2-chloroanilino group, a 2-chloro-5-tetradecaneamidoanilino group, a 2-chloro-5-ddodecyloxycarbonylanilino group, an N-acetylanilino group and a 2-chloro-5-{2-(3-t-butyl-4-hydroxyphenoxy}decaneamido}anilino group), ureido groups (for example, an N-phenylureido group, an N-methylureido group and an N-dibutylureido group), sulfamoylamino group (for example, an N,N-dipropylsulfamoylamino group and N-methyl-N-decylsulfamoylamino group), sulfonamide groups (for example, a methanesulfonamide group, a butanesulfonamide group, a hexadecanesulfonamide group, a benzenesulfonamide group, a p-toluenesulfonamide group, an octadecanesulfonamide group and a 2-methoxy-5-t-butylbenzenesulfonamide group), alkoxycarbonylamino group (for example, a methoxycarbonylamino group and a tetradecyloxycarbonylamino group), aryloxycarbonylamino groups (for example, a phenoxycarbonylamino group), carbamoyl group (for example, an N-ethylcarbamoyl group, an N,N-dibutylcarbamoyl group, an N-(2-dodecyloxyethyl)carbamoyl group, N-methyl-N-dodecylcarbamoyl group and an N-{3-(2,4-di-t-amylphenoxy)propyl}carbamoyl group), sulfamoyl groups (for example, an N-ethylsulfamoyl group, N,N-dipropylsulfamoyl group, an N-(2-dodecyloxyethyl)sulfamoyl group, an N-dodecylsulfamoyl group and an N,N-diethylsulfamoyl group), sulfonyl groups (for example, a methanesulfonyl group, a butanesulfonyl group, an octanesulfonyl group, a dodecanesulfonyl group, a benzenesulfonyl group and a p-toluenesulfonyl group), sulfinyl groups (for example, a dodecanesulfinyl group, a 3-pentadecylphenylsulfinyl group and a 3-phenoxypropylsulfinyl group), phosphonyl groups (for example, a phenoxyphosphonyl group, an octyloxyphosphonyl group and a phenylphosphonyl group), alkoxycarbonyl groups (for example, a methoxycarbonyl group, a butoxycarbonyl group, an octylcarbonyl group, a dodecyloxycarbonyl group and an octadecyloxycarbonyl group), aryloxycarbonyl groups (for example, a phenoxycarbonyl group), acyl groups (for example, an acetyl group, a 3-phenylpropanoyl group, a benzoyl group and a 4-dodecyloxybenzoyl group), a cyano group, a carboxyl group, a sulfo group and imide groups (for example, an N-succinic acid imide, an N-phthalimido group and a 3-octadecenyl succinic acid imide) are cited; $R^{10}$ and $R^{30}$ represent a carbamoyl group (for example, an N-dodecylcarbamoyl group, an N-(2-chloro-5-acetoamidophenyl)carbamoyl group and an N-{2-(2,4-di-t-amylphenoxy)acetoamidophenyl}carbamoyl group), an alkoxycarbonyl group (for example, a 2-ethylhexyloxycarbonyl group and a dodecyloxycarbonyl group), an ureido group (for example, a 2-(2-acetoamidophenyl)ureido group and a 2-(3-methanesulfonylpropyl)ureido group), an anilino group (for example, a 2-{2-(2,5-di-t-amylphenoxy)butaneamido}anilino group and a 4-methanesulfonamidoanilino group) and a cyano group.

$R^{81}$ represents an aryl group (for example, a phenyl group, a 2-methoxyphenyl group, a 2-{2-(2,5-di-t-amylphenoxy)pentaneamido}phenyl group, a 4-hexadecyloxyphenyl group, a 3-acetoamidophenyl group and a 3-methanesulfonamidophenyl group); $R^{82}$ represents an aryl group (for example, a phenyl group, a 2-methoxyphenyl group, a 2-{2-(2,5-di-t-amylphenoxy)-pentaneamido}phenyl, a 4-hexadecyloxyphenyl group, a 3-acetoamidophenyl group and a 3-methanesulfonamidophenyl group), an alkoxyl group (for example, a methoxy group, an ethoxy group, a propoxy group and a dodecyloxy group), an aryloxy group (for example, a phenoxy group, a 2-methylphenoxy group and 4-t-butylphenoxy group), a heterocyclic oxy group (for example, a 1-phenyltetrazole-5-oxy and a 2-tetrahydropyranyloxy group), an alkylthio group (for example, a methyl thio group, an octyl thio group, a tetradecyl thio group, an octadecyl thio group, a 3-phenoxypropyl thio group and a 3-(4-t-butylphenoxy)propyl thio group), an arylthio group (for example, a phenylthio group, a 2-buthoxy-5-t-octylphenylthio group, a 3-pentadecylphenyl thio group, a 2-carboxyphenyl thio and a 4-tetradecaneamidophenyl thio group), a heterocyclicthio group (for example, a 2-benzothiazolylthio group, a 2,4-diphenoxy-1,3,5-triazole-6-thio group and a 2-pyridylthio group) and a 1-pyrazole group (for example, a 3,5-dimethyl-1-pyrazole group and a 4-chloro-3,5-dimethyl-1-pyrazole group).

In addition, $R^{73}$ and $R^{74}$ may be joined together to form a condensed ring (for example, a naphthalene ring, an indolenine ring, an indanone ring and a benzimidazolone ring); Y represents a carbonyl group, a thiocarbonyl group, a sulfur atom, a surfinyl group, a sulfonyl group, a —N(Ra)— group and a P(Ra)— group; V and W respectively represent a group having 0.4 to 2.0 of $\sigma_p$ value (these groups can be selected from J. Org. Chem., 23, 420–427 (1958) and *Structure-Activity Relationship Quantitative Approaches—The Applications to Drug Design and Mode of Action Studies* published by Nankodo including a cyano group, acyl groups (for example, an acetyl group, a butanoyl group and a benzoyl group), carbamoyl groups (for example, an N-pentylcarbamoyl group, an N-dodecylcarbamoyl group and an N-(4-methoxyphenyl)carbamoyl group), sulfonyl groups (for example, a methanesulfonyl group, benzenesulfonyl group and a 4-methylbenzenesulfonyl group), sulfamoyl groups (for example, an N-ethylsulfamoyl group and an N,N-diethylsulfamoyl group), alkoxycarbonyl groups (for example, an ethoxycarbonyl group, a pentyloxycarbonyl group, a dodecyloxycarbonyl group, a trifluoromethoxycarbonyl group); Ra represents a hydrogen atom, an alkyl group (for example, straight-chained or branch chained substituent including a methyl group, an ethyl group, a propyl group, an amyl group, a 2-ethylhexyl group or substituted groups including a benzyl group, a 2-carboxyethyl group, a 2-hydroxyethyl group, a 2-methylsulfonylaminoethyl group, a 2-methoxyethyl, a 2-(2-methoxyethoxy)ethyl group and a 3-sulfopropyl group), an aryl group (for example, a phenyl group, a 4-t-butylphenyl group, a 4-methoxyphenyl group, a 4-methanesulfonylphenyl group, a 3-methanesulfonylaminophenyl group, a 4-chlorophenyl group, a 4-trifluoromethylphenyl group, a 2-methoxyphenyl group and a 2-acetylaminophenyl group) and a heterocyclic group (for example, a 2-pyridyl group, a 2-furyl group, a 2-pyrimidyl group, a thienyl group and a 2-thiazolyl group); in Formulas 1 to 9, dyes used in the present invention are selected preferably from azomethine dye compounds represented by Formulas 1, 2, 3, 5 and 9 in terms of the absorption maximum region and the half-band width of the absorption region.

Next, the following are the typical examples of compounds used in the present invention selected from azomethine dye compounds represented by the abovementioned Formula 1 to 9.

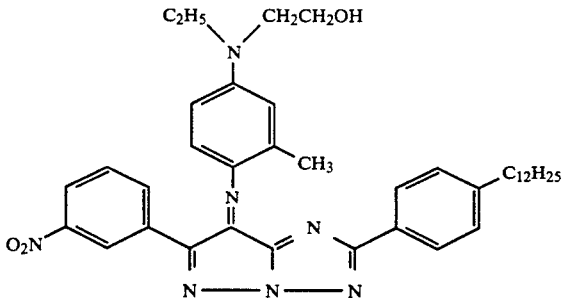
DYE-1
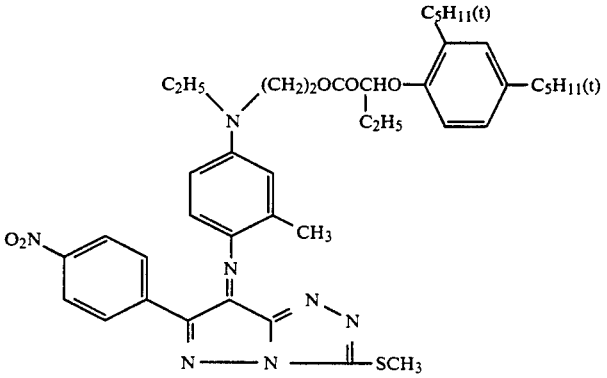
DYE-2
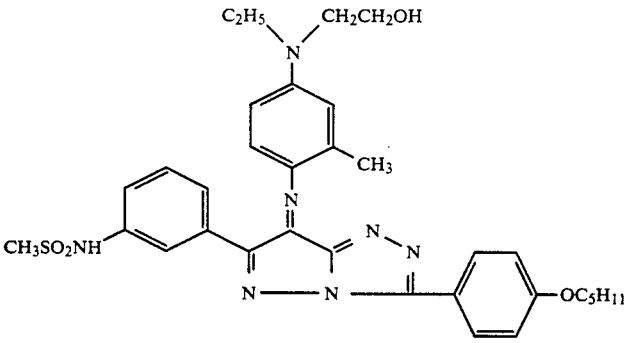
DYE-3
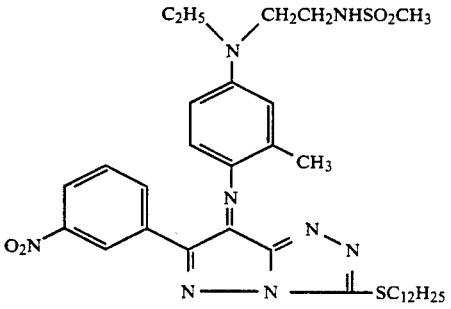
DYE-4

-continued
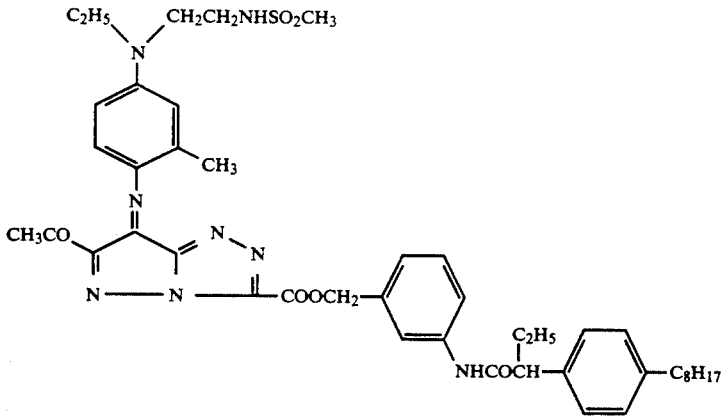
DYE-5
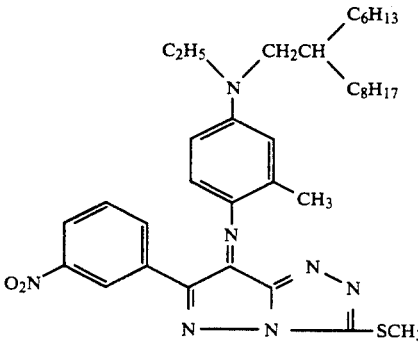
DYE-6
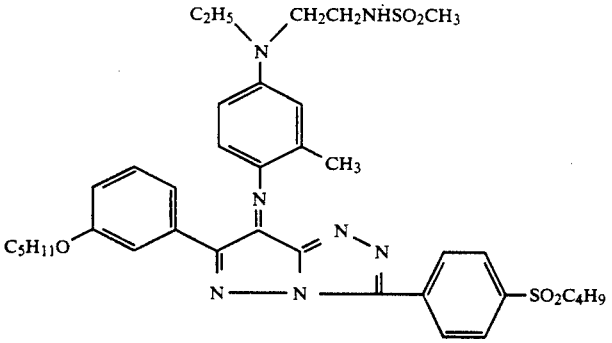
DYE-7
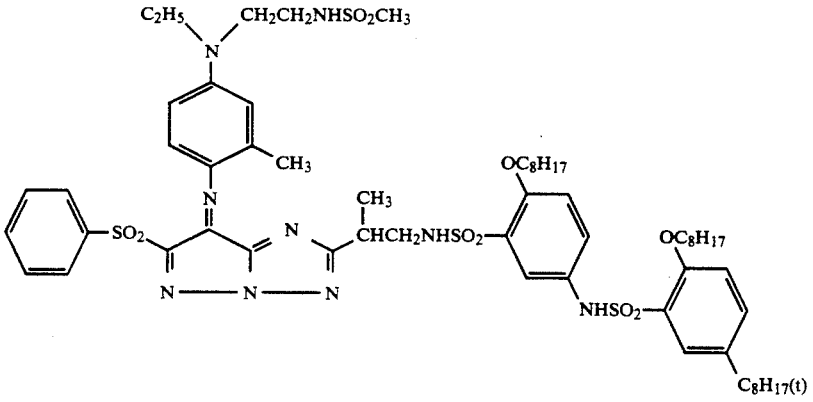
DYE-8

-continued
DYE-9
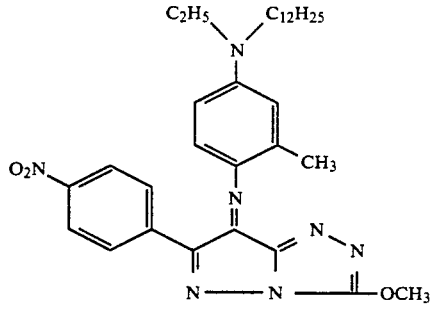
DYE-10
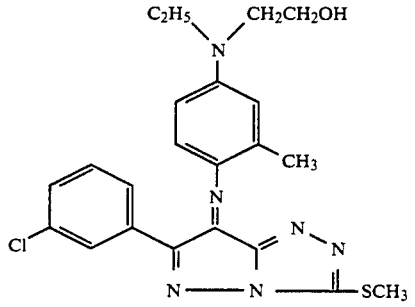
DYE-11
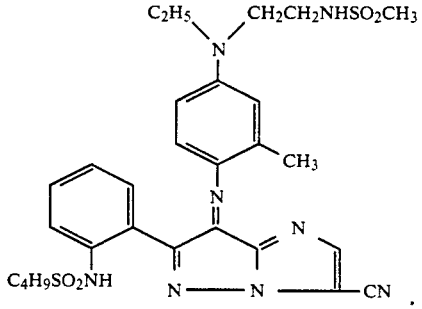
DYE-12
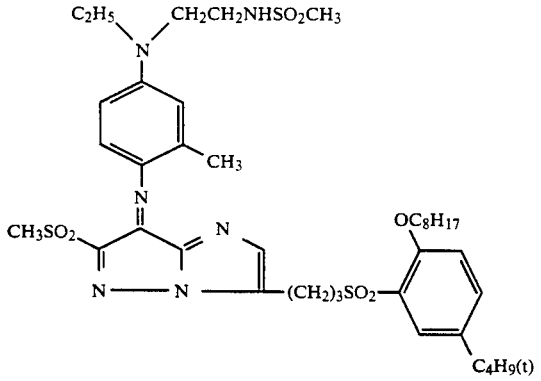
DYE-13
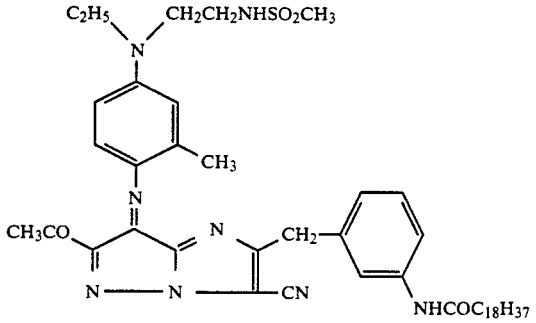

-continued
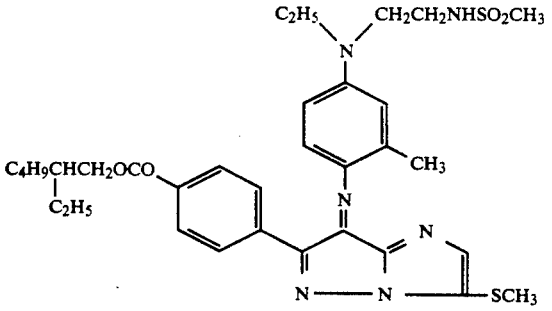
DYE-14
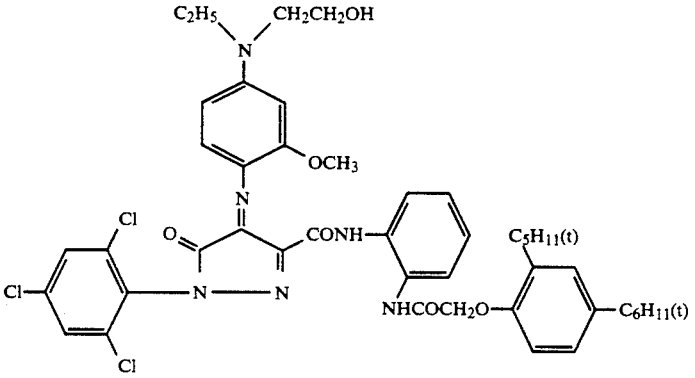
DYE-15
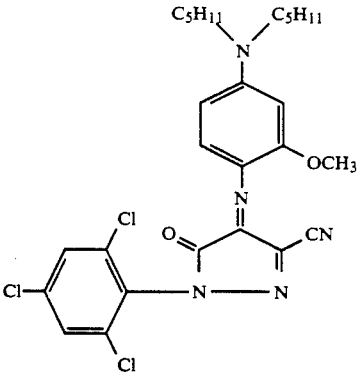
DYE-16
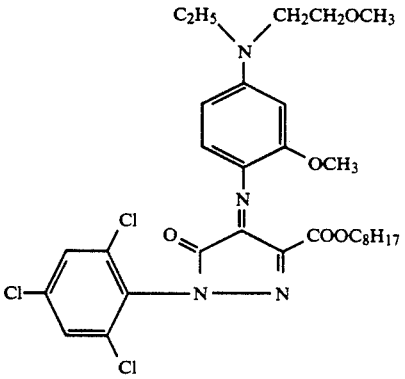
DYE-17

-continued
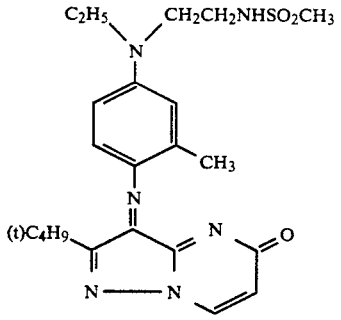
DYE-18
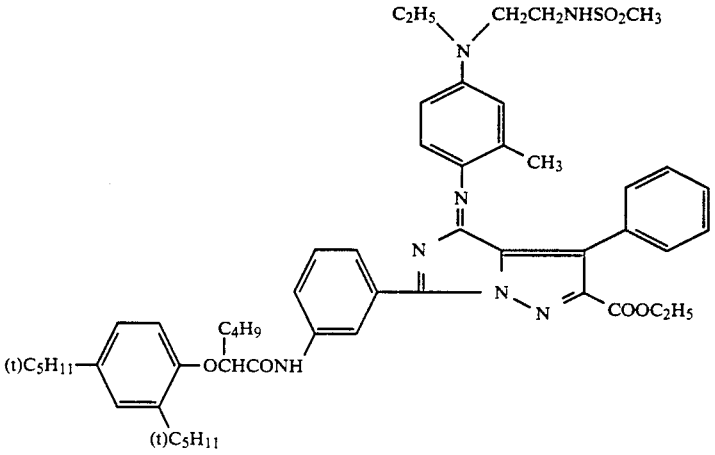
DYE-19
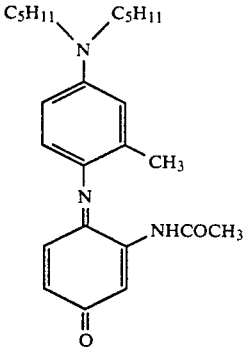
DYE-20
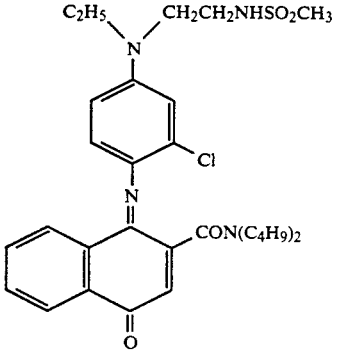
DYE-21

-continued
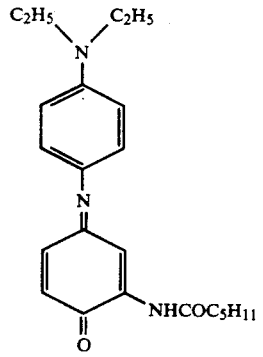
DYE-22
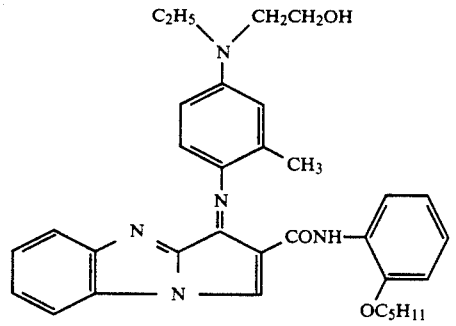
DYE-23
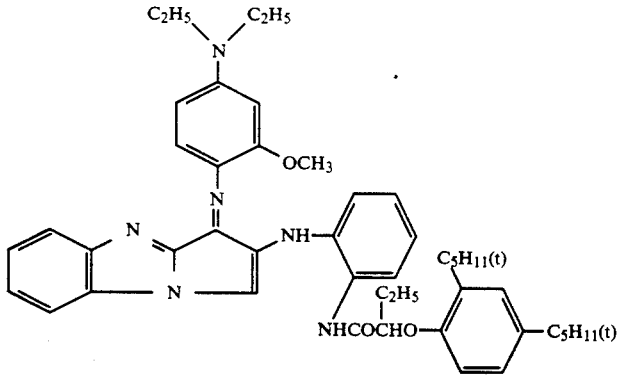
DYE-24
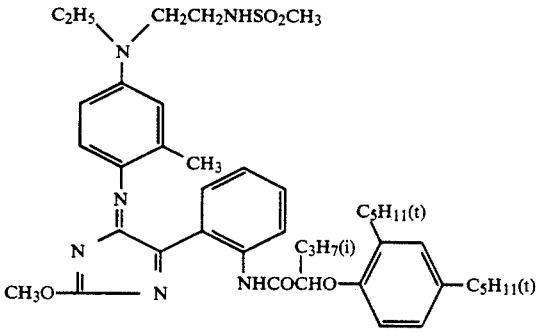
DYE-25

-continued
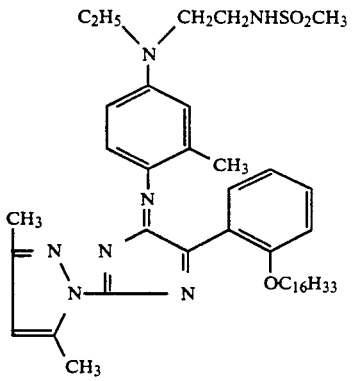
DYE-26
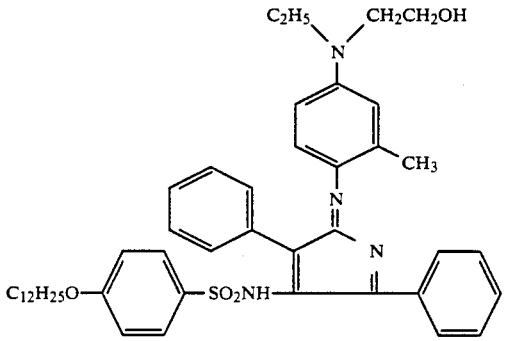
DYE-27
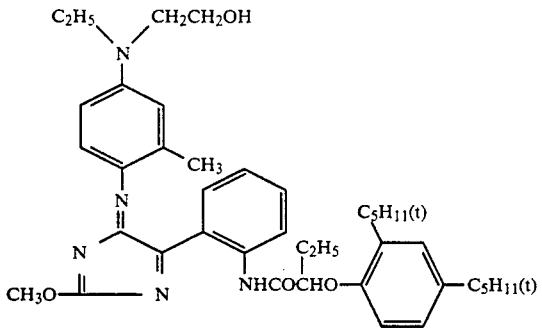
DYE-28
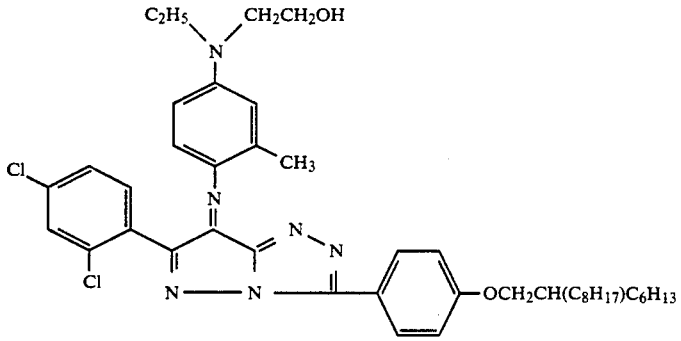
DYE-29

-continued
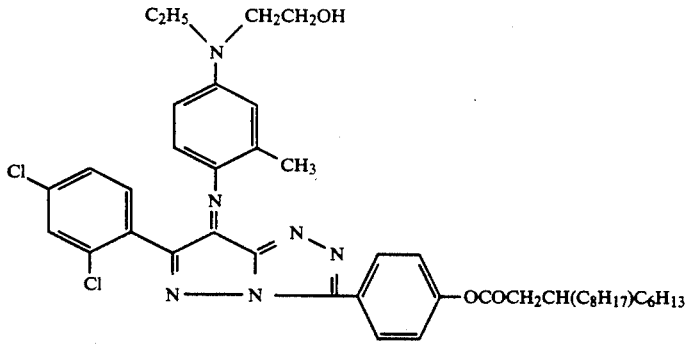
DYE-30
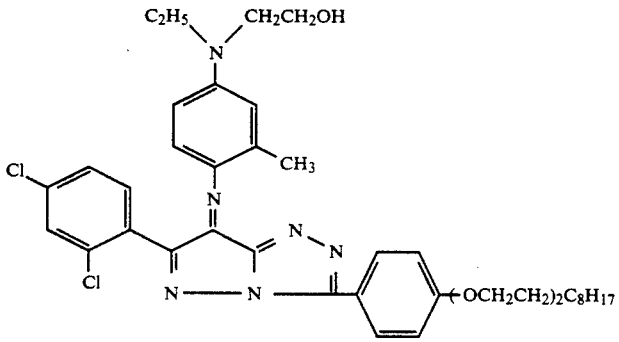
DYE-31
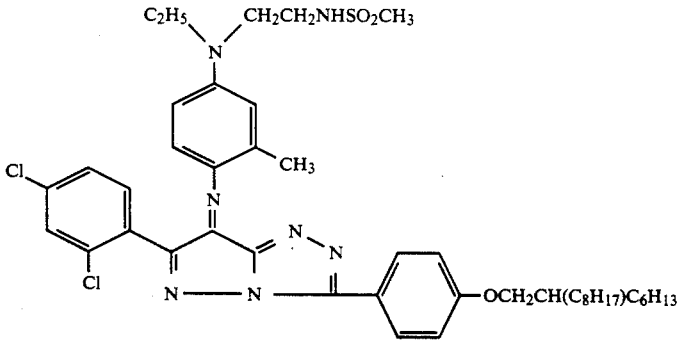
DYE-32
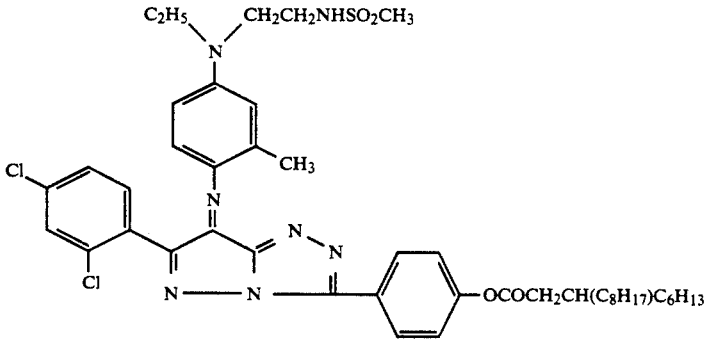
DYE-33

-continued
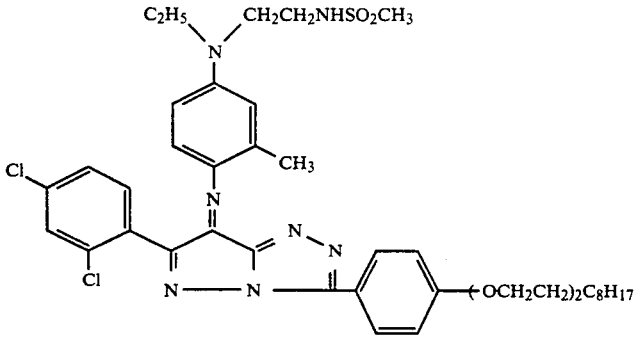
DYE-34
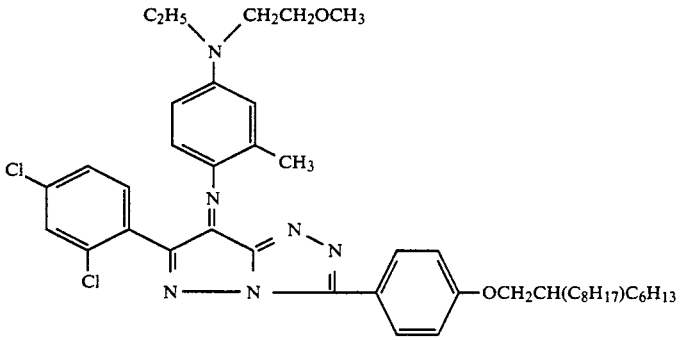
DYE-35
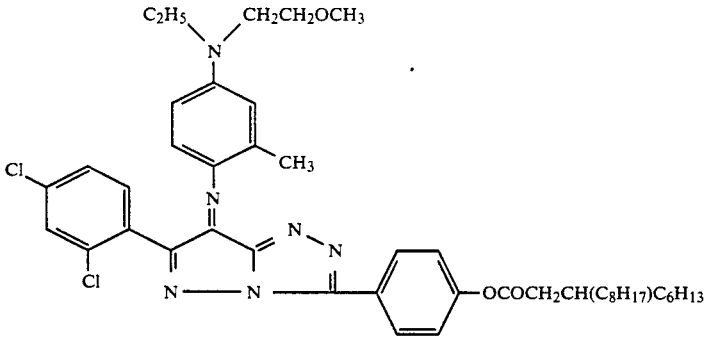
DYE-36
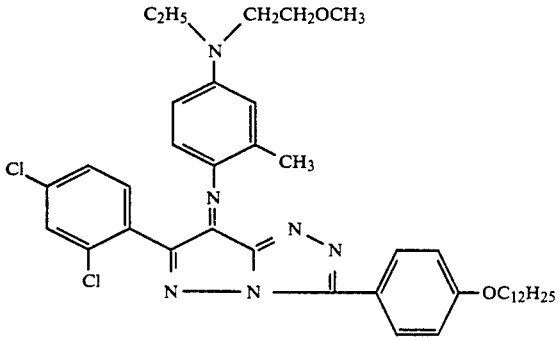
DYE-37

-continued
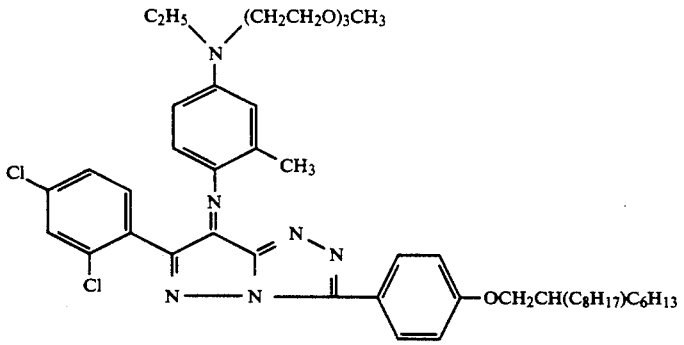
DYE-38
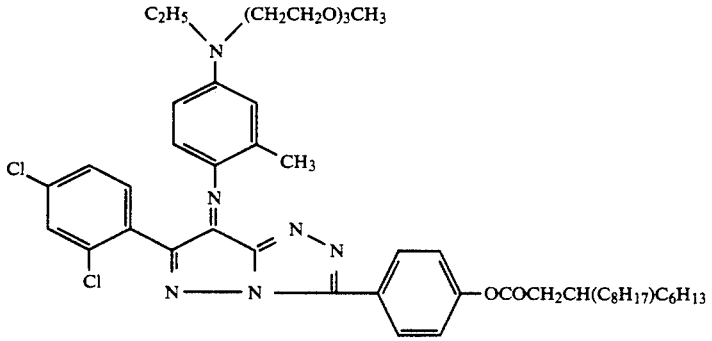
DYE-39
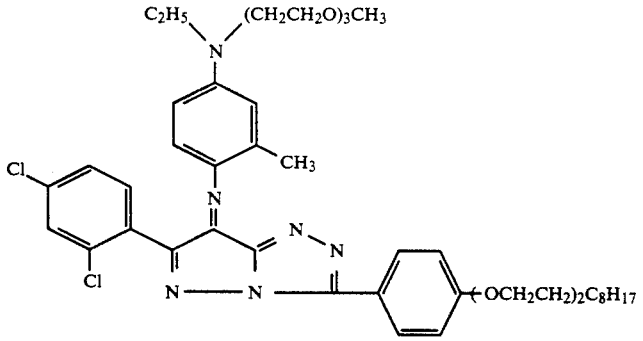
DYE-40
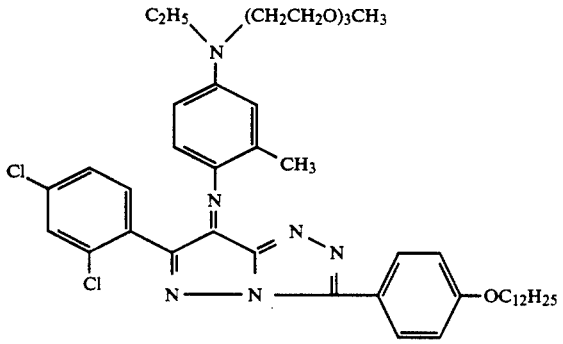
DYE-41

-continued

DYE-42

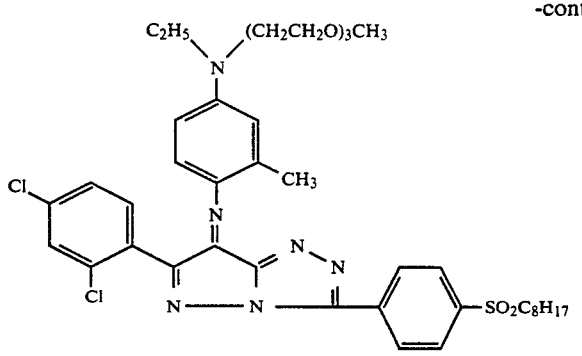

DYE-43

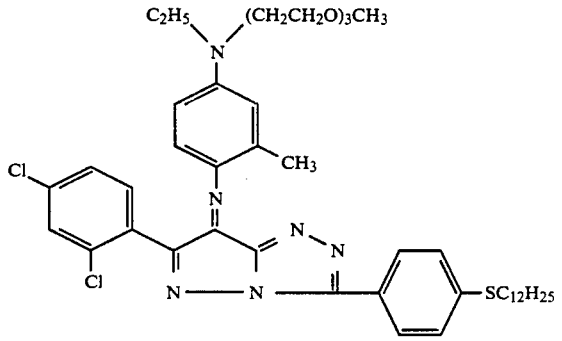

The above-mentioned azomethine dye compounds are selected from compounds described in Japanese Patent O.P.I. Publication Nos. 186567/1985, 113077/1988, 145281,1988, 48862, 1989 and 48862/1989. In addition, they can be synthesized by oxidation-coupling coupler compounds synthesized in Japanese Patent O.P.I. Publication Nos. 213937/1985, 3658/1989, 26853/1989, 28638/1989, 32260/1989, 46753/1989, 48862/1989, 48863/1989, 105250/1989, 105251/1989, W.O. No. 2467/1986, U.S. Pat. No. 3,705,869 and Research Disclosure No. 12443 and a phenylenediamine derivative synthesized in reference of Japanese Patent O.P.I. Publication Nos. 64933/1973 and 9512/1981, U.S. Pat. No. 3,705,035 and J. Am. Chem. Soc., 73,3100 to 3125 through a method described in Japanese Patent O.P.I. Publication No. 32851/1985

Though there is no limit in the adding position of the above-mentioned dyes, it is preferable to add them to the layer nearest to the support in the case when the improvement in fluctuation between different types of printers is the main object of the invention, and it is preferable to add them in a green sensitive emulsion layer far from the support, when the improvement of color reproducibility is the main object.

In addition, with regard to the addition amount of the dyes in the present invention, it is preferable to be 0.001 to 1.0 g/m$^2$, and particularly preferable to be 0.003 to 0 1 g/m$^2$.

Next, we will explain a spectral sensitizing dye represented by Formula S-I in the present invention.

Formula S-I

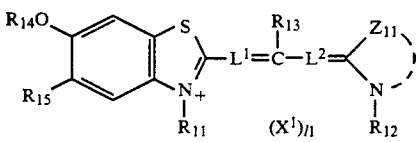

wherein $R_{11}$ and $R_{12}$ represent an alkyl group having 1 to 9 carbons or an alkenyl group having 3 to 9 carbons respectively; $R_{13}$ represents a hydrogen atom, a heterocyclic group, an aryl group or an alkyl group; $R_{14}$ and $R_{15}$ respectively represent an alkyl group; $Z_{11}$ represents nonmetallic atoms necessary for forming 5-membered monocyclic compound or a condensed 5-membered heterocycle containing nitrogen; $L^1$ and $L^2$ represents a methine group respectively; $R_{11}$ and $L^1$ and $R_{12}$ and $L^2$ may be joined together to form a 5-membered or a 6-membered heterocycle; $X^1$ represents an ion cancelling an electric charge; $1^l$ represents the number of ion necessary for cancelling the electric charge inside the molecule; when the compound forms an intramalecular salt. $1^l$ is 0.

In compounds represented by Formula S-I, $R_{11}$ and $R_{12}$ represent an alkyl group having 1 to 10 carbons or an alkenyl group 3 to 10 carbons. Said alkyl group and an alkenyl group may be straight-chained or branch-chained. As an alkyl group, for example, a methyl group, an ethyl group, a propyl group, a butyl group, a pentyl group, an iso-pentyl group, a 2-ethylhexyl hexyl group, an octyl group and a decyl group are cited. As an alkenyl group, for example, a 2-propenyl group, a 3-butenyl group, a 1-metyl-3-propenyl group, a 3-pentenyl group, a 1-methyl-3-butenyl group and a 4-hexenyl group are cited. The above-mentioned groups may be substituted by a halogen atom (for example, a fluorine atom, a chlorine atom and a bromine atom) and a substituent including an alkoxyl group (for example, a methoxy group and an ethoxy group), an aryloxy group (for example, a phenoxy group and a p-tolyloxy group), a cyano group, a carbamoyl group (for example, a carbamoyl group, an N-methylcarbamoyl group and an N,N-tetramethylenecarbamoyl group), a sulfamoyl group (for example, a sulfamoyl group and an N,N-3-oxapentamethyleneaminosulfonyl group), a methanesulfonyl group, an alkoxycarbonyl group (for example, an ethoxycarbonyl group and a butoxycarbonyl group), an aryl group (for example, a phenyl group and a carboxyphenyl group), an acyl group (for example, an acetyl group and a benzoyl group), an acylamino group (for example, an acetylamino group and a benzoylamino group) and a sulfonamide group (for example, a methanesulfonamide group and a butanesulfonamide group). they preferably have a water-soluble group (for example, a sulfo group, a carboxy group, a phosphono group, a sulfino group, a hydroxyl group).

As an alkyl group wherein a water-soluble group is substituted, for example, a carboxymethyl group, a sulfoethyl group, a sulfopropyl group, a sulfobutyl group, a sulfopentyl group, a 3-sulfobutyl group, a hydroxyethyl group, a carboxyethyl group, a 3-sulfinobutyl group, a 3-phosphonopropyl group, a p-sulfobenzyl group and an o-carboxybenzyl group are cited. As an alkenyl group wherein a water-soluble group is substituted, for example, a 4-sulfo-3-butenyl group and a 2-carboxy-2-propenyl group are cited.

As an alkyl group represented by $R_{13}$, $R_{14}$ and $R_{15}$, chained groups having 1 to 6 carbons (for example, a methyl group, an ethyl group, a propyl group, a butyl group, a pentyl group and a hexyl group) are cited. As heterocycles represented by $R_{13}$, for example, a 2-furyl group, a 2-thienyl group and a 1,3-bis(2-methoxyethyl)-6-hydroxy-2,4-dioxo-1,2,3,4-tetrahydropyridine-5-il are cited. As aryl groups, a phenyl group and a naphtyl group are cited.

The above-mentioned alkyl groups, heterocycles and aryl groups may have a substituent at optional positions. For example, optional groups including halogen atoms (a fluorine atom, a chlorine atom, a bromine atom and a iodine atom), a trifluoromethyl group, alkoxyl groups (for example, unsubstituted alkoxy groups such as a methoxy group, an ethoxy group and a buthoxy group and substituted groups such as a 2-methoxyethoxy group and a benzyloxy group), a hydroxyl group, a cyano group, an aryloxy group (for example, substituent and unsubstituent aryloxy groups such as a phenoxy group and a tolyloxy group), aryl groups (for example, a phenyl group, a p-chlorophenyl group, a p-carboxyphenyl group and an o-sulfophenyl group), a stylyl group, heterocycles (for example, a thiazolyl group, a pyridyl group, a furyl group and a thienyl group), carbamoyl groups (for example, a carbamoyl group and an N-ethylcarbamoyl group), sulfamoyl groups (for example, a sulfamoyl group and an N,N-dimethylsulfamoyl group), acylamino groups (for example, an acetylamino group, a propionylamino group and a benzoylamino group), acyl groups (for example, an acetyl group and a benzoyl group), an alkoxycarbonyl group (for example, an ethoxycarbonyl group), sulfonamide groups (for example, a metasulfonamide group and a benzenesulfonamide group), sulfonyl groups (for example, a methanesulfonyl group, a butanesulfonyl group and a p-toluenesulfonyl group), a sulfo group, a carboxyl group and alkyl groups (for example, substituted and unsubstituted alkyl groups such as a methyl group, an ethyl group, an iso-propyl group, a methoxyethyl group, a cyanomethyl group and a cyclohexyl group).

As 5-membered monocycle or condensed 5-membered heterocycles containing nitrogen formed by $Z_{11}$, for example, oxazol type rings (for example, an oxazoline ring, an oxazolidine ring, a benzooxazoline ring, a tetrahydrobenzooxazoline ring and a naphthoxazoline ring), thiazole type rings (for example, a thiazoline ring, a thiazolidine ring, a 1,3,4-thiadiazoline ring, a benzothiazoline ring, a tetrahydrobenzothiazoline ring and a naphthothiazoline ring), selenazole type rings (for example, a selenazoline ring, a selenazolidine ring, a tetrahydrobenzoselenazoline ring, a benzoselenazoline ring and a naphthoselenazoline ring), imidazole type rings (for example, an imidazoline ring, an imidazolidine ring, a benzimidazoline ring and a naphthoimidazoline ring) are cited. A substituent may be provided at an optional position on the above-mentioned rings. Optional groups including, for example, halogen atoms (a fluorine atom, a chlorine atom, a bromine atom and a iodine atom), alkoxyl groups (for example, unsubstituted alkoxy groups such as a methoxy group, an ethoxy group and a buthoxy group and substituted alkoxy groups such as a 2-methoxyethoxy group and a benzyloxy group), a hydroxyl group, a cyano group, aryloxy groups (for example, substituted and unsubstituted aryloxy groups such as a phenoxy group and a tolyloxy group), aryl groups (for example, substituted and unsubstituted aryl groups such as a phenyl group, a p-chlorophenyl group), a styryl group, heterocycles (for example, a thiazolyl group, a pyridyl group, a furyl group and a thienyl group), a carbamoyl group (for example, a carbamoyl group and an N-ethylcarbamoyl group), sulfamoyl groups (for example, a sulfamoyl group and an N,N-dimethylsulfamoyl group), acylamino groups (for example, an acetylamino group, a propionylamino group and a benzoylamino group), acyl groups (for example, an acetyl group and a benzoyl group), alkoxycarbonyl groups (for example, an ethoxycarbonyl group), sulfonamide groups (for example, methanesulfonamide group, a butanesulfoneamide group and a p-toluenesulfonyl group), a carboxyl group and alkyl groups (for example, substituted and unsubstituted chained or ring alkyl groups such as a methyl group, an ethyl group, an iso-propyl group, a methoxyethyl group, a cyanomethyl group and a cyclohexyl group) can be substituted thereto.

Methine groups represented by $L^1$ and $L^2$ include substituted and unsubstituted groups. As examples of substituents, alkyl groups (for example, substituted and unsubstituted alkyl groups such as a methyl group, an ethyl group, an iso-butyl group, a methoxy group), aryl groups (for example, substituted and unsubstituted aryl groups such as a phenyl group and a p-chlorophenyl group), alkoxyl groups (for example, a methoxy group and an ethoxy group) and aryloxy groups (a phenoxy group and a naphthoxy group) are cited.

Ions represented by $X^1$ counteracting electric charge inside molecules are selected from anions or cations. Anions include organic and inorganic ones. Practically, halide ions (for example, a chloride ion, a bromide ion and an iodide ion), organic acid anion (for example, each ion including a p-toluenesulfonate, a p-chlorobenzenesulfonate and a methanesulfonate), a tetrafuluoroboron ion, a perchlorate ion, a methylsulfate ion and an ethylsulfate ion are cited. Cations include organic and inorganic ones. Practically, a hydrogen ion, an alkali metal ion (for example, each ion of a lithium ion, a sodium ion, a potassium ion and a cesium ion), alkali earth metal ions (for example, each of magnesium ion and a calcium ion), an ammonium ion and organic ammonium ions (for example, each ion of trimethylammonium ion, a triethylammonium ion, a tripropyl ammonium ion, a triethanol ammonium ion and a pyridinium ion) are cited.

In Formula S-I, at least one of the groups of $R_{11}$ and $R_{12}$ preferably substitutes a water-soluble group such as a carboxy group, a phosphono group, a hydroxy group and a sulfo group.

The following are practical examples of sensitizing dyes represented by Formula S-I.

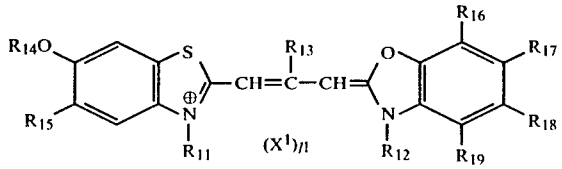

| No. | $(X^1)_l$ | $R_{11}$ | $R_{12}$ | $R_{13}$ | $R_{14}$ | $R_{15}$ | $R_{16}$ | $R_{17}$ | $R_{18}$ | $R_{19}$ |
|---|---|---|---|---|---|---|---|---|---|---|
| 1 | — | $-CH_2COOH$ | $-(CH_2)_3SO_3^{\ominus}$ | $-C_2H_5$ | $-CH_3$ | $-CH_3$ | $-H$ | — | 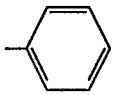 | $-H$ |
| 2 | $HN^{\oplus}(C_2H_5)_3$ | $-(CH_2)_2SO_3^{\ominus}$ | $-(CH_2)_4O_3^{\ominus}$ | $-C_2H_5$ | $-CH_3$ | $-CH_3$ | $-H$ | $-H$ | $-Cl$ | $-H$ |
| 3 | $Li^{\oplus}$ | $-(CH_2)_4SO_3^{\ominus}$ | $-(CH_2)_2SO_3^{\ominus}$ | $-C_2H_5$ | $-CH_3$ | $-CH_3$ | $-H$ | $-H$ | 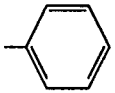 | $-H$ |
| 4 | $Li^{\oplus}$ | $-(CH_2)_2SO_3^{\ominus}$ | $-(CH_2)_4SO_3^{\ominus}$ | $-C_2H_5$ | $-CH_3$ | $-CH_3$ | $-H$ | $-H$ | $-OCH_3$ | $-H$ |
| 5 | $HN^{\oplus}(C_2H_5)_3$ | 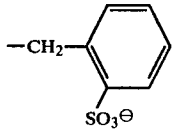 | $-(CH_2)_4SO_3^{\ominus}$ | $-C_2H_5$ | $-CH_3$ | $-CH_3$ | $-H$ | $-CH_3$ | $-Cl$ | $-H$ |
| 6 | $Li^{\oplus}$ | $-(CH_2)_4SO_3^{\ominus}$ | $-(CH_2)_3SO_3^{\ominus}$ | $-C_2H_5$ | $-CH_3$ | $-CH_3$ | $-H$ | $-H$ | $-Cl$ | $-H$ |
| 7 | — | $-(CH_2)_4SO_3^{\ominus}$ | $-(CH_2)_2OH$ | $-CH_3$ | $-CH_3$ | $-C_2H_5$ | $-H$ | $-CH_3$ | $-H$ | $-H$ |
| 8 | — | $-(CH_2)_2SO_3^{\ominus}$ | $-(CH_2)_4SO_3H$ | $-CH_3$ | $-CH_3$ | $-CH_3$ | $-H$ | $-H$ | $-Cl$ | $-H$ |
| 9 | — | $-CH_2COOH$ | $-(CH_2)_4SO_3^{\ominus}$ | $-C_3H_7(n)$ | $-CH_3$ | $-CH_3$ | $-H$ | $-H$ | $-CH_3$ | $-H$ |
| 10 | $HN^{\oplus}(C_2H_5)_3$ | $-(CH_2)_4SO_3^{\ominus}$ | $-(CH_2)_2SO_3^{\ominus}$ | 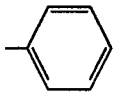 | $-CH_3$ | $-CH_3$ | $-H$ | $-H$ | $-Cl$ | $-H$ |
| 11 | $Li^{\oplus}$ | $-(CH_2)_3SO_3^{\ominus}$ | $-(CH_2)_4SO_3^{\ominus}$ | $-H$ | $-C_3H_7(n)$ | $-CH_3$ | $-H$ | $-H$ | $-Cl$ | $-H$ |
| 12 | $Na^{\oplus}$ | $-(CH_2)_4SO_3^{\ominus}$ | $-(CH_2)_2SO_3^{\ominus}$ | $-C_2H_5$ | $-CH_3$ | $-CH_3$ | $-H$ | | 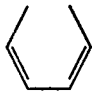 | $-H$ |

-continued

| | | | | | | | | | | |
|---|---|---|---|---|---|---|---|---|---|---|
| 13 | — | $-(CH_2)_5SO_3^{\ominus}$ | $-CH_2COOH$ | 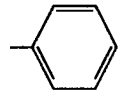 | $-C_2H_5$ | $-C_2H_5$ | $-H$ | $-H$ | $-Cl$ | $-H$ |
| 14 | $Na^{\oplus}$ | $-(CH_2)_4SO_3^{\ominus}$ | $-(CH_2)_2SO_3^{\ominus}$ | $-C_2H_5$ | $-C_2H_5$ | $-CH_3$ | $-H$ | $-Cl$ | $-H$ | $-H$ |
| 15 | — | $-CH_2COOH$ | $-(CH_2)_4SO_3^{\ominus}$ | $-C_2H_5$ | $-CH_3$ | $-CH_3$ | $-H$ | $-H$ | $-C_5H_{11}(t)$ | $-H$ |
| 16 | $HN^{\oplus}(C_2H_5)_3$ | $-(CH_2)_2SO_3^{\ominus}$ | $-(CH_2)_3SO_3^{\ominus}$ | $-C_2H_5$ | $-CH_3$ | $-CH_3$ | $-H$ | $-H$ | 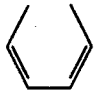 | |

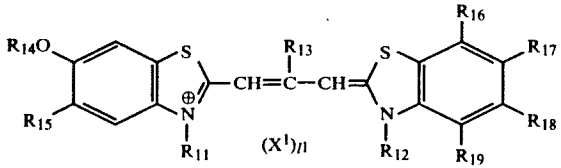

| No. | $R_{11}$ | $R_{12}$ | $R_{13}$ | $R_{14}$ | $R_{15}$ | $R_{16}$ | $R_{17}$ | $R_{18}$ | $R_{19}$ | $(X^1)_{l1}$ |
|---|---|---|---|---|---|---|---|---|---|---|
| 17 | $-(CH_2)_2SO_3^{\ominus}$ | $-(CH_2)_4SO_3^{\ominus}$ | $-C_2H_5$ | $-CH_3$ | $-CH_3$ | $-H$ | $-H$ | $-Cl$ | $-H$ | $Li^{\oplus}$ |
| 18 | $-(CH_2)_4SO_3^{\ominus}$ | $-(CH_2)_4SO_3^{\ominus}$ | $-C_2H_5$ | $-CH_3$ | $-CH_3$ | $-H$ | $-H$ | $-OCH_3$ | $-H$ | $HN^{\oplus}(C_2H_5)_3$ |
| 19 | $-(CH_2)_5SO_3^{\ominus}$ | $-CH_2COOH$ | $-C_2H_5$ | $-CH_3$ | $-CH_3$ | $-H$ | $-H$ | $-CH_3$ | $-H$ | — |
| 20 | 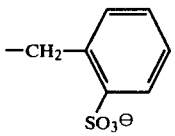 | 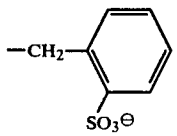 | $-C_2H_5$ | $-C_2H_5$ | $-CH_3$ | $-H$ | $-H$ | 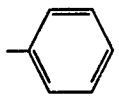 | $-H$ | $HN^{\oplus}(C_2H_5)_3$ |
| 21 | $-(CH_2)_3SO_3^{\ominus}$ | $-(CH_2)_2SO_3^{\ominus}$ | $-C_3H_7$ | $-CH_3$ | $-CH_3$ | $-H$ | $-H$ | $-Cl$ | $-H$ | $HN^{\oplus}(C_2H_5)_3$ |
| 22 | $-(CH_2)_3SO_3^{\ominus}$ | $-(CH_2)_3SO_3^{\ominus}$ | $-C_2H_5$ | $-CH_3$ | $-CH_3$ | $-H$ | $-OCH_3$ | $-CH_3$ | $-H$ | $Li^{\oplus}$ |
| 23 | $-(CH_2)_5SO_3^{\ominus}$ | $-(CH_2)_5SO_3^{\ominus}$ | $-CH_3$ | $-CH_3$ | $-CH_3$ | $-H$ | $-OCH_3$ | $-CH_3$ | $-H$ | $Na^{\oplus}$ |
| 24 | $-(CH_2)_4SO_3^{\ominus}$ | $-(CH_2)_4SO_3^{\ominus}$ | 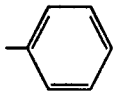 | $-CH_3$ | $-CH_3$ | $-H$ | $-OCH_3$ | $-CH_3$ | $-H$ | $HN^{\oplus}(C_2H_5)_2$ |
| 25 | $-CH_2COOH$ | $-(CH_2)_4SO_3^{\ominus}$ | $-C_2H_5$ | $-CH_3$ | $-CH_3$ | $-H$ | $-OCH_3$ | $-CH_3$ | $-H$ | — |
| 26 | $-(CH_2)_2SO_3^{\ominus}$ | $-(CH_2)_2SO_3^{\ominus}$ | $-C_2H_5$ | $-CH_3$ | $-CH_3$ | $-H$ | $-OCH_3$ | $-CH_3$ | $-H$ | $HN^{\oplus}(C_2H_5)_3$ |
| 27 | $-(CH_2)_2SO_3^{\ominus}$ | $-(CH_2)_2SO_3^{\ominus}$ | $-C_2H_5$ | $-C_2H_5$ | $-CH_3$ | $-H$ | $-OC_2H_5$ | $-CH_3$ | $-H$ | $K^{\oplus}$ |
| 28 | $-CH_2COOH$ | $-(CH_2)_2SO_3^{\ominus}$ | $-C_2H_5$ | $-CH_3$ | $-CH_3$ | $-H$ | $-H$ | $-Cl$ | $-H$ | — |

-continued

| | | | | | | | | | | | |
|---|---|---|---|---|---|---|---|---|---|---|---|
| 29 | $-(CH_2)_2SO_3^{\ominus}$ | $-(CH_2)_3SO_3^{\ominus}$ | $-C_2H_5$ | | $-CH_3$ | $-CH_3$ | $-H$ | $-H$ | | | $K^{\oplus}$ |
| 30 | $-CH_2COOH$ | $-CH_2COO^{\ominus}$ | $-CH_2-$ | | $-C_3H_7$ | $-CH_3$ | $-H$ | $-OC_3H_7$ | $-CH_3$ | $-H$ | — |
| 31 | $-(CH_2)_4SO_3^{\ominus}$ | $-(CH_2)_4SO_3^{\ominus}$ | $-CH_3$ | | $-CH_3$ | $-CH_3$ | $-H$ | $-CH_3$ | $-CH_3$ | $-H$ | $HN^{\oplus}(C_2H_5)_3$ |
| 32 | $-(CH_2)_2SO_3^{\ominus}$ | $-(CH_2)_2SO_3^{\ominus}$ | $-$ | | $-CH_3$ | $-CH_3$ | $-H$ | $-CH_3$ | $-H$ | $-H$ | $Li^{\oplus}$ |
| 33 | $-(CH_2)_3SO_3^{\ominus}$ | $-(CH_2)_3SO_3^{\ominus}$ | $-H$ | | $-CH_3$ | $-CH_3$ | $-H$ | $-OCH_3$ | $-CH_3$ | $-H$ | $HN^{\oplus}(C_2H_5)_3$ |
| 34 | $-(CH_2)_3SO_3^{\ominus}$ | $-(CH_2)_3SO_3^{\ominus}$ | S | | $-CH_3$ | $-CH_3$ | $-H$ | $-OCH_3$ | $-CH_3$ | $-H$ | $Na^{\oplus}$ |
| 35 | $-C_2H_5$ | $-C_2H_5$ | $CH_3OH_4C_2$, N, O, N, $C_2H_4OCH_3$, O, $O^{\ominus}$ | | $-CH_3$ | $-CH_3$ | $-H$ | $-OCH_3$ | $-CH_3$ | $-H$ | — |

| No. | $R_{11}$ | $R_{12}$ | $R_{13}$ | $Y^1$ | $R_{14}$ | $R_{15}$ | $R_{16}$ | $R_{17}$ | $R_{18}$ | $R_{19}$ | $(X^1)_{l1}$ |
|---|---|---|---|---|---|---|---|---|---|---|---|
| 36 | $-(CH_2)_2SO_3^{\ominus}$ | $-(CH_2)_2SO_3^{\ominus}$ | $-C_2H_5$ | Se | $-CH_3$ | $-CH_3$ | $-H$ | $-H$ | $-CH_3$ | $-H$ | $HN^{\oplus}(C_2H_5)_3$ |
| 37 | $-CH_2COOH$ | $-(CH_2)_4SO_3^{\ominus}$ | $-CH_3$ | Se | $-CH_3$ | $-CH_3$ | $-H$ | $-H$ | $-Cl$ | $-H$ | — |
| 38 | $-(CH_2)_4SO_3^{\ominus}$ | $-(CH_2)_4SO_3^{\ominus}$ | $-C_2H_5$ | Se | $-CH_3$ | $-CH_3$ | $-H$ | $-H$ | $-H$ | $-H$ | $Li^{\oplus}$ |
| 39 | $-CH_2COOH$ | $-(CH_2)_5SO_3^{\ominus}$ | $-H$ | Se | $-CH_3$ | $-CH_3$ | $-H$ | $-H$ | $-H$ | $-H$ | — |
| 40 | $-(CH_2)_3SO_3^{\ominus}$ | $-(CH_2)_3SO_3^{\ominus}$ | $-C_2H_5$ | Se | $-C_2H_5$ | $-CH_3$ | $-H$ | $-H$ | $-CH_3$ | $-H$ | $Li^{\oplus}$ |
| 41 | $-(CH_2)_3SO_3^{\ominus}$ | $-(CH_2)_3SO_3^{\ominus}$ | $-H$ | $>NC_2H_5$ | $-CH_3$ | $-CH_3$ | $-H$ | $-Cl$ | $-Cl$ | $-H$ | $K^{\oplus}$ |

-continued
| | | | | | | | | | | | |
|---|---|---|---|---|---|---|---|---|---|---|---|
| 42 | $-CH_2COOH$ | $-(CH_2)_2SO_3^{\ominus}$ | $-H$ | $>NC_2H_5$ | $-CH_3$ | $-CH_3$ | $-H$ | $-CN$ | $-Cl$ | $-H$ | — |
| 43 | 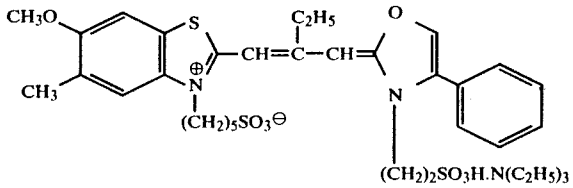 | | | | | | | | | | |
| 44 | 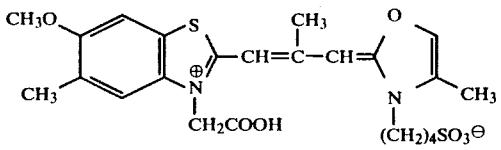 | | | | | | | | | | |
| 45 | 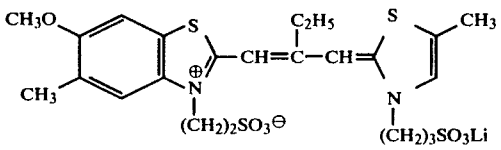 | | | | | | | | | | |

In the present invention, the above-mentioned compounds are preferably employed with sensitizing dyes represented by the following Formula S-II or Formula S-III in combination because desired spectral wavelength region and higher red optical sensitivity are obtained.

Formula S-II

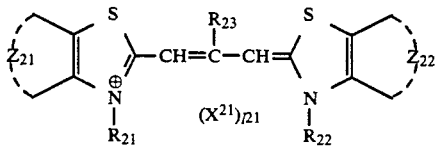

Formula S-III

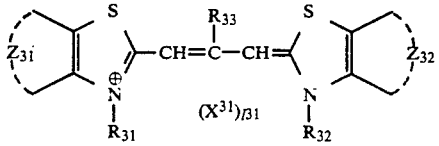

In the above-mentioned Formulas S-II and S-III, $R_{21}$, $R_{22}$, $R_{31}$ and $R_{32}$ represent alkyl groups or alkenyl groups respectively each having 1 to 9 carbons, and they are the same as $R_{11}$ and $R_{12}$ in Formula S-I. $R_{23}$ and $R_{33}$ represent an alkyl group, a heterocycle or an aryl group respectively. They are the same as $R_{13}$ in Formula S-I.

$Z_{21}$ and $Z_{22}$ represent nonmetallic atoms necessary for forming a benzene ring. $Z_{31}$ represents nonmetallic atoms necessary for forming a benzene ring or a naphthalene ring. $Z_{32}$ represents nonmetallic atoms necessary for forming a naphthalene ring. The above-mentioned atoms can have a substituent explained in $Z_{11}$ in Formula S-I at optional position.

$X^{21}$ and $X^{31}$ represent ions counteracting electric charge inside molecules. They are the same as $X^1$ in Formula S-I. $l^{21}$ and $l^{31}$ represent numbers necessary for counteracting electric charge inside molecules. When the compounds form intramolecular salts, $l^{21}$ and $l^{31}$ represent 0.

The compounds represented by Formula S-II are selected from compounds of Formula S-I described in pp. 401 to 401 of Japanese Patent O.P.I. Publication 223748/1987. The compounds represented by Formula S-III are selected from compounds of Formula S-II described in pp. 401 to 401 of Japanese Patent O.P.I. Publication 223748/1987.

The compounds in the present invention can be synthesized by conventional methods described in *Berichte*, 40,4319 (1907), *Journal of Chemical Society*, 127, 42 to 48 (1925), *Journal of the American Chemical Society*, 39,2198 (1917) and 41,1453 (1919), the specification of U.S. Pat. No. 4,515,888 and *The Cyanine Dyes and Related compounds* written by F. M. Harmer (1964, published by Inter Science publishers).

Sensitizing dyes represented by the above-mentioned Formulas S-I, S-II and S-III used in the present invention can be added to the silver halide emulsion by conventional methods. Sensitizing dyes can be added into an emulsion by selecting from the plotonation dissolution and addition method described in Japanese Patent O.P.I. Publication Nos. 80826/1975 and 80827/1975, methods to disperse and add sensitizing dyes employing surfactants described in U.S. Pat. No. 3,822,135, Japanese Patent O.P.I. Publication Nos. 11419/1975, 135437/1990 and 135438/1990, methods to add sensitizing dyes by dispersing them into hydrophilic substrates described in U.S. Pat. Nos. 3,676,147, 3,469,987, 4,247,627, Japanese Patent O.P.I. Publication Nos. 59942/1976, 16624/1978, 102732/1978, 102733/1978 and 137131/1978, methods to add light-sensitive dyes in the form of solid solution described in East Germany Patent No. 143,324, Research Disclosure No. 21,802 and methods to dissolve sensitizing dyes into water-soluble solvent (for example, low-boiling solvents such as water, methanol, ethanol, propylalcohol, acetone and alcohol fluoride and high-boiling solvents such as dimethylformamide, methylcellosolve and phenylcellosolve) to be added.

The addition time of sensitizing dyes represented by the above-mentioned Formulas S-I, S-II and S-III may be either of a stage from physical ripening to the end of chemical ripening or a stage in the course of emulsion preparation step from the end of chemical ripening to coating. However, it is preferable to be added in a stage from physical ripening to the end of chemical ripening.

In the step of physical ripening or chemical ripening, it is preferable to add a sensitizing dye prior to the addition of a chemical sensitizer or immediately after the addition of chemical sensitizer because higher spectral sensitivity can be obtained.

The addition amount of spectral sensitizer in the present invention varies depending upon the conditions used and the kind of emulsion to a great extent. However, it is preferable to be $1\times10^{-6}$ mol to $5\times10^{-3}$ mol, and more preferable to be $2\times10^{-6}$ mol to $2\times10^{-3}$ mol per mol of silver halide.

When 2 or more sensitizing dyes in the present invention are employed in combination, the ratio of employing thereof can be selected optionally depending upon the amounts which give prescribed sensitivity. In addition, the sensitizing dyes in the present invention can offer preferable effect. When they are used together with conventional supersensitizers. As examples of the above-mentioned supersensitizers, each compound described in pp. 323–326 of Japanese Patent O.P.I. Publication No. 174740/1987 is cited.

As silver halide in a silver halide emulsion used for the silver halide photographic light-sensitive materials in the present invention, optional ones used for conventional silver halide emulsions employing silver bromide, silver iodide, silver chloroiodide, silver chlorobromide and silver chloride can be used.

Silver halide grains used for a silver halide emulsion may be ones having uniform distribution in the composition of silver halide inside the grains or ones having a layer structure wherein the composition of silver halide inside the grains is different from that in the surface layer.

Silver halide grains may be those wherein latent images are mainly formed on the surface thereof or those wherein latent images are mainly formed inside thereof.

Silver halide emulsions may have any kind of grain size distribution. Either emulsions having wide grain size distribution (referred to as a polydisperse emulsion) may be used, or emulsions having narrow grain size distribution (referred to as a monodisperse emulsion) may be used independently or in combination of several types. In addition, a polydisperse emulsion and a monodisperse emulsion can be used in combination.

As a silver halide emulsion, 2 or more silver halide emulsion prepared separately may be used in combination.

Silver halide grains used for the present invention can be chemically sensitized by means of the sulfur sensitization method, the selenium sensitization method, the reduction sensitization method and the noble metal sensitization method.

Among silver halide grains used in the present invention, the silver halide grains other than those spectrally sensitized by means of the combination of sensitizing dyes in the present invention can be spectrally sensitized to prescribed wavelength region employing dyes known as sensitizing dyes in the photographic industry.

To the silver halide emulsion, anti-foggants and stabilizers can be added.

As a binder used for the emulsions and others of the silver halide photographic light-sensitive material in the present invention, it is advantageous to employ gelatin. In addition, gelatin derivatives, graft polymers between gelatin and other polymers, protein, sugar derivatives, cellulose derivatives and hydrophilic colloid including synthetic hydrophilic polymers such as homopolymers and copolymers.

Photographic emulsion layers and other hydrophilic colloidal layers of the silver halide photographic light-sensitive material in the present invention are hardened by bridged binder (or protective colloid) molecules and employing hardeners which enhance the strength of layers independently or in combination.

To a silver halide emulsion, plasticizers and dispersion colloid (latex) of water-insoluble or slightly-soluble polymers can be contained.

In a silver halide photographic light-sensitive material in the present invention, couplers can be used. In addition, competitive couplers having an effect of color correction and compounds releasing photographically useful fragments including development accelerators, bleach accelerators, developing agents, silver halide solvents, toning agents, hardeners, foggants, anti-foggants, chemical sensitizers, spectral sensitizers and desensitizers by means of coupling with an oxidation product of color developing agent.

As yellow couplers, conventional acylacetoanilide type couplers can be used preferably. Of them, benzoylacetoanilide type and pyvaloylacetoanilide type compounds are advantageous.

As magenta couplers, 5-pyrazolone type couplers, pyrazoloazol type couplers, pyrazolobenzimidazole type couplers, open-chained acylacetonitrile type couplers and indazole type couplers can be used.

As cyan couplers, phenol type couplers and naphthol type couplers are used normally. In order to have couplers contained in a light-sensitive material, conventional technologies used for normal couplers can be applied. It is preferable to dissolve couplers to a high boiling solvent and a low boiling solvent in combination if necessary and to disperse them to fine grain and to add them to a silver halide emulsion in the present invention. In this case, hydroquinone derivatives, UV absorbers and anti color fading agent can be used in combination.

To the silver halide photographic light-sensitive material in the present invention, supplementary layers such as a filter layer, anti-halation layer and an anti-irradiation layer can be provided. In the above-mentioned layers and/or emulsion layers, dyes flow out from the light-sensitive material in the course of development processing or bleached may be contained.

To the silver halide photographic light-sensitive material in the present invention, a matting agent, a lubricant, an image stabilizer, a UV absorber, a fluorescent brightening agent, a surfactant, a development accelerator, a development retarder and a bleach accelerator can be added.

Photographic emulsion layers and other layers of the silver halide photographic light-sensitive material in the present invention can be provided on a baryta paper, a paper laminated with α-olefin polymer, a paper support wherein a paper support and an α-olefin layer can be separated easily, flexible reflective support including a synthetic paper, films composed of semi-synthetic or synthetic polymers including cellulose acetate, cellulose nitrate, polystyrene, polychlorovinyl, polyethyleneterephthalate, polycarbonate and polyamide, reflective support on which a white pigment is coated and rigid bodies such as glass, metal and earthenwares. In addition, they can be provided on a thin reflective support of 120 to 160 μm.

When the silver halide photographic light-sensitive material in the present invention contains a coupler, in order to obtain dye images, conventional color photographic processing is conducted after exposure.

In the present invention, the silver halide photographic light-sensitive material may be processed with a processing solution having bleaching ability and a processing solution having a fixing ability immediately after being subjected to color developing, or it may be processed with a processing solution having fixing ability as well as having bleaching ability (so-called a bleach-fixer). As bleaching agents used for said bleaching, metal complex of organic acid is used.

After fixing processing, washing processing is conducted normally. In addition, in place of washing processing, either stabilization processing may be conducted or both of them may be conducted in combination.

The following are practical examples of the present invention.

EXAMPLE 1

On a triacetylcellulose support, each layer having the following composition was formed in this order from the support side to prepare a multi-color photographic light-sensitive material samples 1 to 19.

Incidentally, the addition amount in the multi-layer photographic light-sensitive material indicates the number of gram per $m^2$, except otherwise described. In addition, silver halides and colloidal silvers were indicated in conversion of silver. Sensitizing dyes were indicated in terms of mol per mol of silver.

| | |
|---|---|
| First layer; Anti-halation layer (HC) | |
| Black colloidal silver | 0.15 |
| UV absorver (UV-1) | 0.20 |
| Colored cyan coupler (CC-1) | 0.02 |
| Dye (described in Table 1) | 0.02 |
| High boiling solvent (Oil-1) | 0.20 |
| High boiling solvent (Oil-2) | 0.20 |
| Gelatin | 1.6 |
| Second layer; Intermediate layer (IL-1) | |
| Gelatin | 1.3 |
| Third layer; | |
| Low speed red sensitive emulsion layer (RL) | |
| Silver iodobromide emulsion (Em-1) | 0.4 |
| Silver iodobromide emulsion (Em-2) | 0.3 |
| Sensitizing dye (S-A) | $3.2 \times 10^{-4}$ |
| Sensitizing dye (S-2) | $3.2 \times 10^{-4}$ |
| Sensitizing dye (S-3) | $0.2 \times 10^{-4}$ |
| Cyan coupler (C-1) | 0.50 |
| Cyan coupler (C-2) | 0.13 |

-continued

| | |
|---|---|
| Colored cyan coupler (CC-1) | 0.07 |
| DIR compound (D-1) | 0.01 |
| High boiling solvent (Oil-1) | 0.55 |
| Gelatin | 1.0 |
| Fourth layer; | |
| High speed red sensitive emulsion layer (RH) | |
| Silver iodobromide emulsion (Em-3) | 0.9 |
| Sensitizing dye (S-A) | $1.7 \times 10^{-4}$ |
| Sensitizing dye (S-2) | $1.6 \times 10^{-4}$ |
| Sensitizing dye (S-3) | $0.1 \times 10^{-4}$ |
| Cyan coupler (C-2) | 0.23 |
| Colored cyan coupler (CC-1) | 0.03 |
| DIR compound (D-1) | 0.02 |
| High boiling solvent (Oil-1) | 0.25 |
| Gelatin | 1.0 |
| Fifth layer; Intermediate layer (IL-2) | |
| Gelatin | 0.8 |
| Sixth layer; | |
| Low speed green sensitive emulsion layer (GL) | |
| Silver iodobromide emulsion (Em-1) | 0.6 |
| Silver iodobromide emulsion (Em-2) | 0.2 |
| Sensitizing dye (S-4) | $6.7 \times 10^{-4}$ |
| Sensitizing dye (S-5) | $0.8 \times 10^{-4}$ |
| Magenta coupler (M-1) | 0.47 |
| Colored cyan coupler (described in Table 1) | 0.10 |
| DIR compound (D-3) | 0.02 |
| High boiling solvent (Oil-2) | 0.70 |
| Gelatin | 1.0 |
| Seventh layer; | |
| High speed green sensitive emulsion layer (GL) | |
| Silver iodobromide emulsion (Em-3) | 0.9 |
| Sensitizing dye (S-6) | $1.1 \times 10^{-4}$ |
| Sensitizing dye (S-7) | $2.0 \times 10^{-4}$ |
| Sensitizing dye (S-8) | $0.3 \times 10^{-4}$ |
| Magenta coupler (M-1) | 0.15 |
| Magenta coupler (M-2) | 0.06 |
| Colored cyan coupler (described in Table 1) | 0.04 |
| DIR compound (D-3) | 0.04 |
| High boiling solvent (Oil-2) | 0.35 |
| Gelatin | 1.0 |
| Eighth layer; Yellow filter layer (YC) | |
| Yellow colloidal silver | 0.1 |
| Additive (SC-1) | 0.12 |
| High boiling solvent (Oil-2) | 0.15 |
| Gelatin | 1.0 |
| Ninth layer; | |
| Low speed blue sensitive emulsion layer (BL) | |
| Silver iodobromide emulsion (Em-1) | 0.25 |
| Silver iodobromide emulsion (Em-2) | 0.25 |
| Sensitizing dye (S-9) | $5.8 \times 10^{-4}$ |
| Yellow coupler (Y-1) | 0.60 |
| Yellow coupler (Y-2) | 0.32 |
| DIR compound (D-2) | 0.01 |
| High boiling solvent (Oil-2) | 0.18 |

-continued

| | |
|---|---|
| Gelatin | 1.3 |
| Tenth layer; | |
| High speed blue sensitive emulsion layer (BH) | |
| Silver iodobromide emulsion (Em-4) | 0.5 |
| Sensitizing dye (S-10) | $3.0 \times 10^{-4}$ |
| Sensitizing dye (S-11) | $1.2 \times 10^{-4}$ |
| Yellow coupler (Y-1) | 0.18 |
| Yellow coupler (Y-2) | 0.10 |
| High boiling solvent (Oil-2) | 0.05 |
| Gelatin | 1.0 |
| Eleventh layer; First protective layer (PRO-1) | |
| Silver iodobromide emulsion (Em-5) | 0.3 |
| UV absorber (UV-1) | 0.07 |
| UV absorber (UV-2) | 0.1 |
| High boiling solvent (Oil-1) | 0.07 |
| High boiling solvent (Oil-3) | 0.07 |
| Gelatin | 1.0 |
| Twelfth layer; Second protective layer (PRO-2) | |
| Alkali-soluble matting agent (average grain size is 2 μm) | 0.13 |
| Polymethylmethacrylate (average grain size is 2 μm) | 0.02 |
| Gelatin | 0.5 |

Incidentally, in addition to the above-mentioned compounds, a coating assistant SU-2, a dispersion assistant SU-1, a hardener H-1 and dyes AI-1 and AI-2.

In addition, the following are emulsions used in the above-mentioned samples. All emulsions are mono-dispersed silver iode bromide emulsions with high iodide content inside thereof.

Em-1:
Average silver iodide content ratio 7.5 mol %
Average grain size 0.55 μm
Form of grain Octahedron Em-2:
Average silver iodide content ratio 2.5 mol %
Average grain size 0.36 μm
Form of grain Octahedron Em-3:
Average silver iodide content ratio 8.0 mol %
Average grain size 0.84 μm
Form of grain Octahedron Em-4:
Average silver iodide content ratio 8.5 mol %
Average grain size 1.02 μm
Form of grain Octahedron Em-5:
Average silver iodide content ratio 2.0 mol %
Average grain size 0.08 μm

C-1

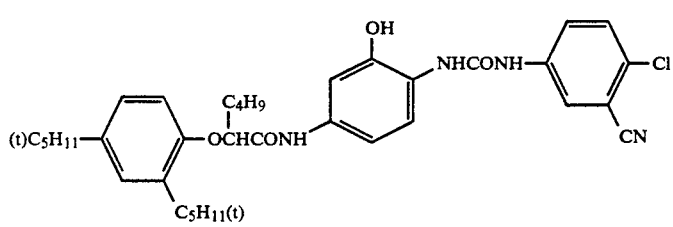

C-2

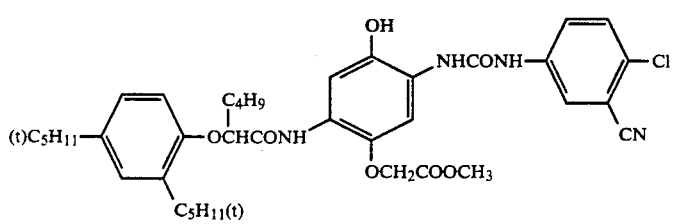

-continued
M-1
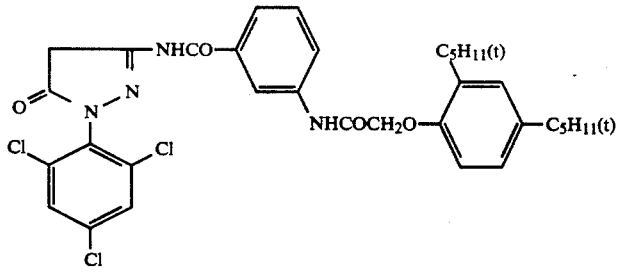
M-2
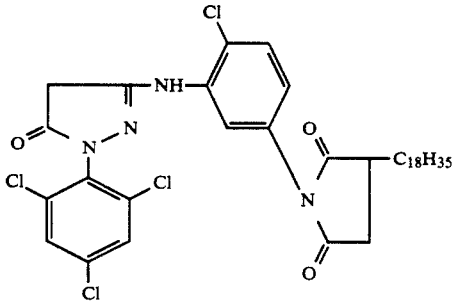
Y-1
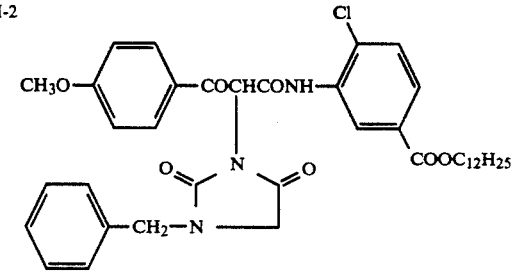
Y-2
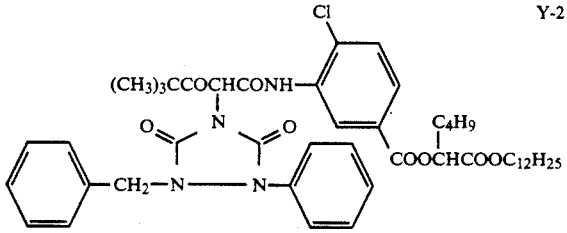
CC-1
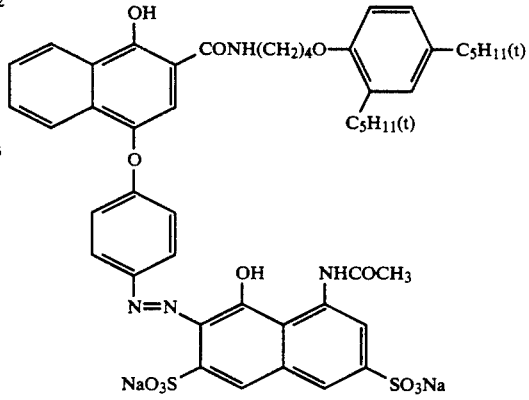
D-1
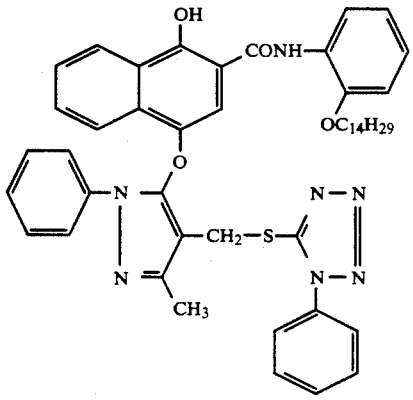
D-2
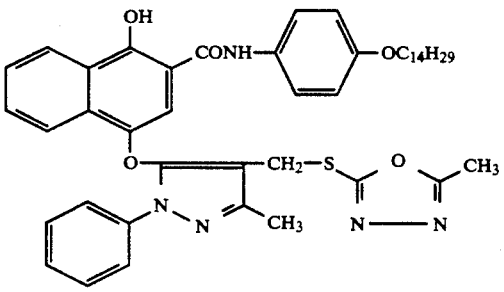

-continued
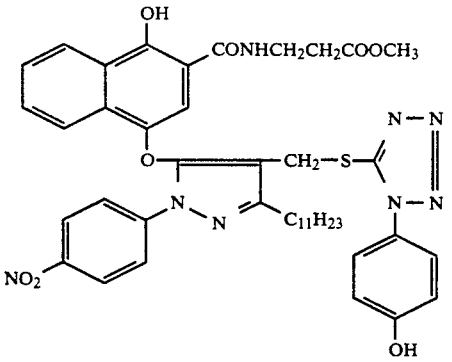
D-3
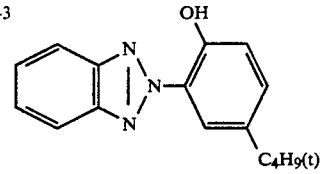
UV-1
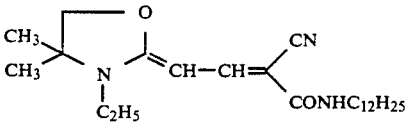
UV-2
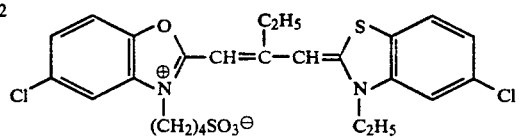
S-A
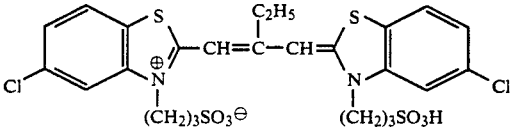
S-2
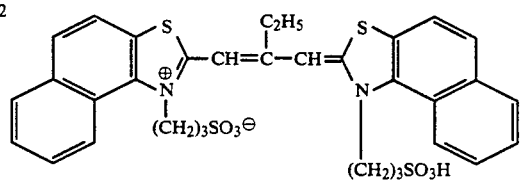
S-3
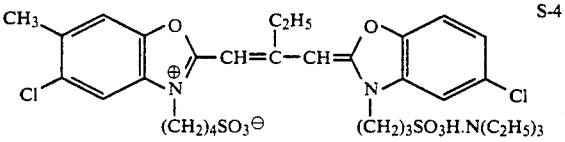
S-4
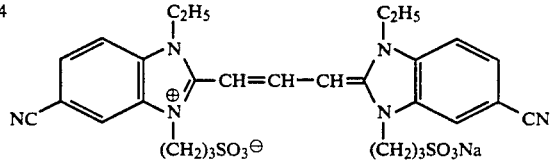
S-5
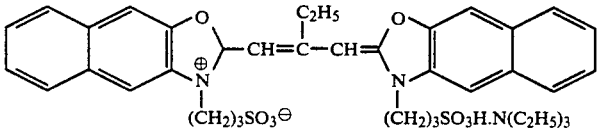
S-6
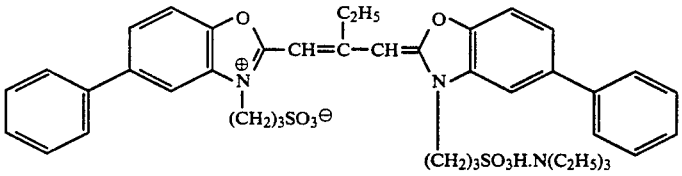
S-7
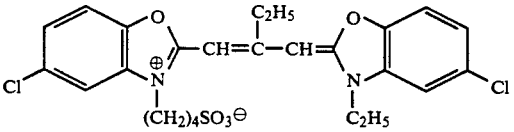
S-8
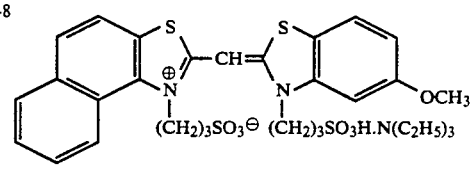
S-9
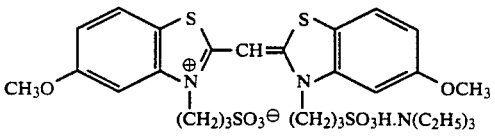
S-10

-continued

S-11

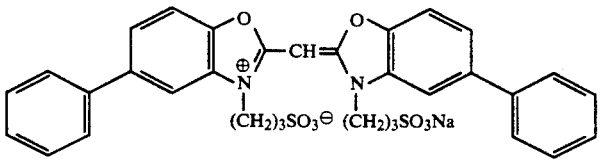

AI-1

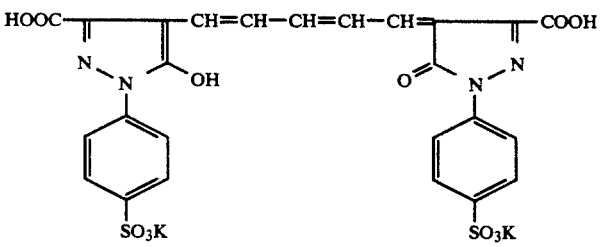

AI-2

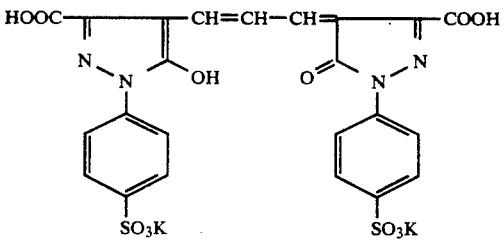

SU-1

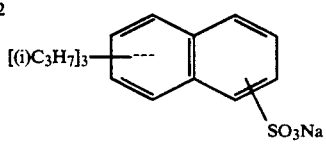

SU-2

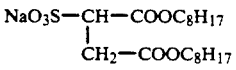

SC-1

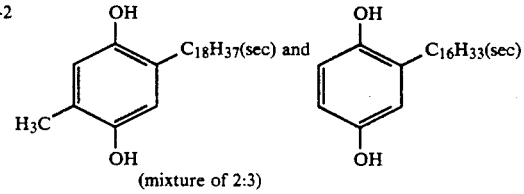

Oil-1

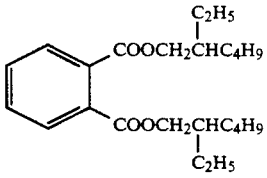

Oil-2

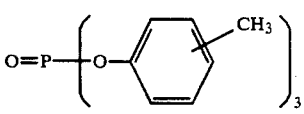

Oil-3

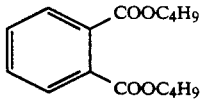

II-1

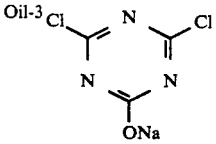

Employing each sample thus prepared and cameras (Konica FT-1 MOTOR: produced by Konica Corporation), color checkers produced by MacBeth were photographed and the following development processing was conducted.

| Processing step (38° C.) | Processing time |
|---|---|
| Color developing | 3 min. and 15 sec. |
| Bleaching | 6 min. and 30 sec. |
| Washing | 3 min. and 15 sec. |
| Fixing | 6 min. and 30 sec. |
| Washing | 3 min. and 15 sec. |
| Stabilizing | 1 min. and 30 sec. |
| Drying | |

The composition of the processing solution used in each processing step is as follows;

| | |
|---|---|
| <Color developer> | |
| 4-amino-3-methyl-N-ethyl-N-(β-hydroxyethyl)aniline sulfate | 4.75 g |
| Sodium disulfate anhydride | 4.25 g |
| Hydroxylamine ½ sulfate | 2.0 g |
| Potassium carbonate anhydride | 37.5 g |
| Sodium bromide | 1.3 g |
| Nitrilo triacetate 3 sodium salt (monohydrade) | 2.5 g |
| Potassium hydroxide | 1.0 g |
| Add water to make 1 l (ph = 10.05) | |
| <Bleacher> | |
| Ethylenediamine tetraacetate ferric (III) ammonium salt | 100.0 g |
| Ethylenediamine tetraacetate diammonium salt | 10.0 g |
| Ammonium bromide | 150.0 g |
| Glacial acetic acid | 10.0 ml |
| Add water to make 1 l, and adjust pH to 6.0 with aqueous ammonium. | |

-continued

| | |
|---|---|
| <Fixer> | |
| Ammonium thiosulfate | 175.0 g |
| Sodium sulfite anhydride | 8.5 g |
| Sodium metasulfite | 2.3 g |
| Add water to 1 l, and adjust pH to 6.0 with acetic acid. | |
| <Stabilizer> | |
| Water | 900 ml |
| Chemical 39 | 2.0 g |

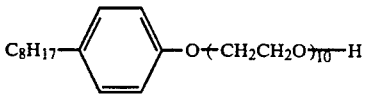

| | |
|---|---|
| Dimethylol urea | 0.5 g |
| Hexamethylenetetramine | 0.2 g |
| 1,2-benzisothiazoline-3-on | 0.1 g |
| Siloxane (L-77, produced by UCC) | 0.1 g |
| Aqueous ammonium | 0.5 ml |

Add water to make 1 l, and adjust pH to 8.5 with aqueous ammonia or 50% sulfate.

Employing a printer A, print samples Nos. 1A to 19A were prepared so that the gray portion in a color checker become gray with the reflection ratio of 18%.

Next, employing a printer B having a different detector on green area, print samples 1B to 19B were prepared under the print conditions of a printer A. The fluctuation between 2 printers were judged visually. The results are shown in Table 1.

In addition, the color reproducibility of the above-mentioned samples 1 to 19 were evaluated by the following method.

At first, employing each sample and a camera (FT-1 MOTOR produced by Konica Corporation), a color checker produced by MacBeth Co., Ltd. was photographed. Next, the samples were subjected to color negative film development processing (CNK-4: produced by Konica Corporation). Then, employing a Konica color printer CL-P2000, the obtained negative images were printed on a Konica color paper Type QAA5 in the size of 82×117 mm to prepare practical prints in the same manner as mentioned above. The conditions of printer in printing were set for each sample so that gray color on a color checker may appear to be gray on a print.

The color reproducibility of practical prints obtained were evaluated by visual check. The results are shown in Table 1.

Next, after Samples 1 to 19 were subjected to sine wave wedge exposure for 1/100 sec. employing white light, they were subjected to the above-mentioned development processing. Then, the sharpness was investigated.

The sharpness was evaluated in terms of MTF (Modulation Transfer Function) value of dye images, and indicated in terms of relative value (Sample 1 was defined to be 100) at 30 line/mm. The results are shown in Table 1.

TABLE 1

| Sample No. | Colored couple magenta 6th layer | Colored couple magenta 7th layer | Dye | Fluctuation between different printers* | Color reproducibility* | Sharpness |
|---|---|---|---|---|---|---|
| 1 (Comparative) | CM-A | CM-A | — | X | X | 100 |
| 2 (Comparative) | CM-A | CM-A | DYE-38 | Δ | Δ | 104 |
| 3 (Comparative) | CM-29 | CM-29 | — | Δ | Δ | 102 |
| 4 (Invention) | CM-29 | CM-29 | DYE-38 | ○ | ○ | 108 |
| 5 (Invention) | CM-29 | CM-29 | DYE-2 | ○ | ○ | 109 |
| 6 (Invention) | CM-29 | CM-29 | DYE-3 | ○ | ○ | 107 |
| 7 (Invention) | CM-29 | CM-29 | DYE-6 | ○ | ○ | 109 |
| 8 (Invention) | CM-29 | CM-29 | DYE-9 | ○ | ○ | 108 |
| 9 (Invention) | CM-29 | CM-29 | DYE-25 | ○ | ○ | 109 |
| 10 (Invention) | CM-29 | CM-29 | DYE-29 | ○ | ○ | 108 |
| 11 (Invention) | CM-29 | CM-29 | DYE-34 | ○ | ○ | 108 |
| 12 (Invention) | CM-29 | CM-29 | DYE-35 | ○ | ○ | 108 |
| 13 (Invention) | CM-29 | CM-29 | DYE-37 | ○ | ○ | 109 |
| 14 (Invention) | CM-29 | CM-29 | DYE-39 | ○ | ○ | 107 |
| 15 (Invention) | CM-29 | CM-29 | DYE-42 | ○ | ○ | 109 |
| 16 (Invention) | CM-32 | CM-32 | DYE-38 | ○ | ○ | 107 |
| 17 (Invention) | CM-13 | CM-13 | DYE-38 | ○ | ○ | 108 |
| 18 (Invention) | CM-27 | CM-27 | DYE-38 | ○ | ○ | 108 |

TABLE 1-continued

| Sample No. | Colored couple magenta 6th layer | 7th layer | Dye | Fluctuation between different printers* | Color reproducibility* | Sharpness |
|---|---|---|---|---|---|---|
| 19 (Comparative) | CM-29 | CM-29 | DYE-A | ○ | ○ | 105 |

*Feeling evaluation by 10 monitors
Fluctuation between different kind of printers:
○ (small fluctuation), Δ (slightly large fluctuation), X (large fluctuation)
Color reproducibility
○ (good), Δ (rather good), X (not good)

CM-A

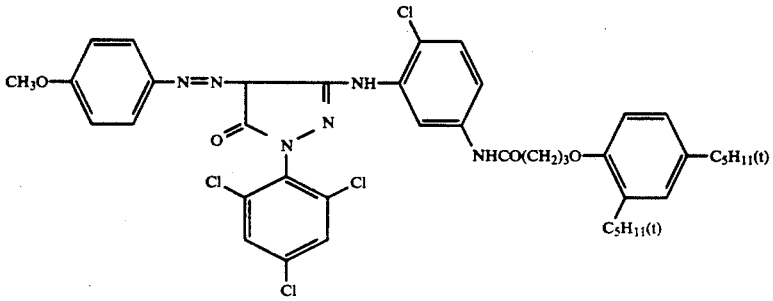

DYE-A

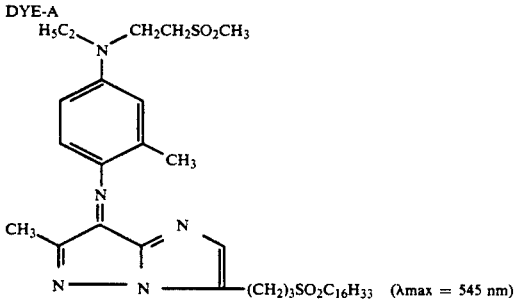

As is apparent from Table 1, sample 1 containing neither the colored magenta couplers in the present invention nor the dyes is poor in fluctuation between 2 printers and color reproducibility, and is insufficient in sharpness.

On the other hand, slight improvement for each evaluation item can be observed in Sample 2 having the dyes in the present invention but having no colored magenta couplers in the present invention. However, their effects are insufficient.

In addition, with regard to Sample 3 containing no dyes of the invention but containing the colored magenta couplers in the present invention and Sample 19 containing dyes other than those in the present invention, slight improvement was observed in color reproducibility and sharpness. However, deterioration in fluctuation between 2 printers is extremely serious so that it is not satisfactory.

On the other hand, with regard to Samples 4 to 18 containing the colored magenta couplers in the present invention and the dyes in the present invention as well, remarkable improvement in fluctuation between 2 printers was observed. In addition, improvement in color reproducibility and sharpness was remarkable, too.

EXAMPLE 2

The dye in the first layer, the sensitizing dye S-A in the third layer and the fourth layer, and the colored magenta couplers in the sixth layer and the seventh layer in Sample 1 of the above-mentioned Example 1 were changed as shown in Tables 2 and 3 for the preparation of Samples 20 to 35.

The fluctuation between printers of Samples 20 to 35 thus prepared and Samples 1 and 3 prepared in Example 1 were visually judged in the same way as in Example 1. In addition, after Samples 20 to 35 and Samples 1 and 3 prepared in Example 1 were subjected to wedge exposure employing white light, they were processed in the same manner as for the above-mentioned Sample 1 to obtain the sensitivity in the red sensitive layer (the inverse of the amount of exposure necessary for giving the fog density+0.3) and fogging. The results are shown together in Tables 2 and 3.

TABLE 2

| Sample No. | Colored coupler magenta 6th layer | 7th layer | Dye | Sensitizing dye 3rd layer | 4th layer | Fogging | Sensitivity*1 | Fluctuation*2 between printers |
|---|---|---|---|---|---|---|---|---|
| 1 (Comparative) | CM-A | CM-A | — | S-A | S-A | 0.32 | 100 | X |
| 3 (Comparative) | CM-29 | CM-29 | — | S-A | S-A | 0.31 | 102 | Δ |
| 20 (Invention) | CM-29 | CM-29 | — | S-2 | S-2 | 0.27 | 119 | ○ |
| 21 (Invention) | CM-29 | CM-29 | — | S-5 | S-5 | 0.28 | 120 | ○ |
| 22 (Invention) | CM-29 | CM-29 | — | S-6 | S-6 | 0.26 | 124 | ○ |
| 23 (Invention) | CM-29 | CM-29 | — | S-8 | S-8 | 0.28 | 121 | ○ |
| 24 (Invention) | CM-13 | CM-13 | — | S-6 | S-6 | 0.27 | 122 | ○ |
| 25 (Invention) | CM-27 | CM-27 | — | S-6 | S-6 | 0.28 | 120 | ○ |

TABLE 2-continued

| Sample No. | Colored coupler magenta 6th layer | Colored coupler magenta 7th layer | Dye | Sensitizing dye 3rd layer | Sensitizing dye 4th layer | Fogging | Sensitivity*1 | Fluctuation*2 between printers |
|---|---|---|---|---|---|---|---|---|
| 26 (Invention) | CM-32 | CM-32 | — | S-6 | S-6 | 0.27 | 121 | ○ |
| 27 (Invention) | CM-13 | CM-13 | — | S-13 | S-13 | 0.29 | 120 | ○ |
| 28 (Invention) | CM-27 | CM-27 | — | S-21 | S-21 | 0.28 | 122 | ○ |
| 29 (Invention) | CM-32 | CM-32 | — | S-38 | S-38 | 0.29 | 121 | ○ |
| 30 (Invention) | CM-29 | CM-29 | DYE-30 | S-2 | S-2 | 0.27 | 120 | ◎ |

TABLE 2

| Sample No. | Colored coupler magenta 6th layer | Colored coupler magenta 7th layer | Dye | Sensitizing dye 3rd layer | Sensitizing dye 4th layer | Fogging | Sensitivity*1 | Fluctuation*2 between printers |
|---|---|---|---|---|---|---|---|---|
| 31 (Invention) | CM-29 | CM-29 | DYE-38 | S-5 | S-5 | 0.28 | 122 | ◎ |
| 32 (Invention) | CM-29 | CM-29 | DYE-38 | S-8 | S-8 | 0.28 | 120 | ◎ |
| 33 (Invention) | CM-13 | CM-13 | DYE-38 | S-6 | S-6 | 0.27 | 123 | ◎ |
| 34 (Invention) | CM-27 | CM-27 | DYE-38 | S-6 | S-6 | 0.27 | 122 | ◎ |
| 35 (Invention) | CM-29 | CM-29 | DYE-38 | S-6 | S-6 | 0.26 | 124 | ◎ |

*1Sensitivity is indicated with Sample 1 as 100.
*2Feeling evaluation by 10 monitors
Fluctuation between printers
◎: Extremely small in fluctuation
○: Small in fluctuation
Δ: Slightly large in fluctuation
X: Large in fluctuation As is apparent from Tables 2 and 3, Sample 1 not in the present invention is low in speed, high in fogging and extremely high in fluctuation between printers. In addition, though improvement in the fluctuation between printers is observed in Sample 3 wherein CM-29 is used as a colored magenta coupler, it is still insufficient, and, no improvement was observed in fogging and speed. On the other hand, each of Samples 20 to 35 using the colored magenta coupler in the present invention and the sensitizing dye in the present invention was high in speed, low in fogging and showed remarkable improvement in fluctuation between printers.

What is claimed is:

1. A silver halide color photographic light-sensitive material comprising a support having thereon a blue-sensitive silver halide emulsion layer, a green-sensitive silver halide emulsion layer and a red-sensitive silver halide emulsion layer, wherein at least one of green-sensitive silver halide emulsion layers contains at least one of colored magenta couplers represented by Formula CM-1 and at least one of dyes having absorption maximum at 590 nm to 610 nm is contained in at least one of layers selected from the layers consisting of silver halide emulsion layers and photographic constitution layers;

Formula CM-1

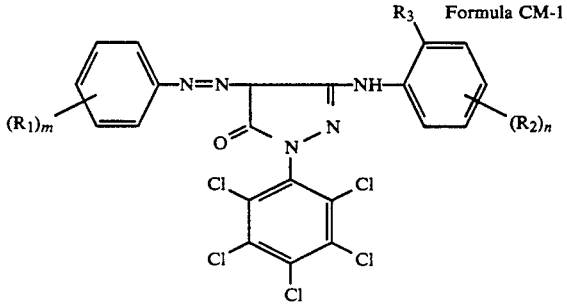

wherein $R_1$ represents a substituent, $R_2$ represents an acylamino group, a sulfonamide group, an imide group, a carbamoyl group, a sulfamoyl group, an alkoxyl group, an alkoxycarbonyl group, an alkoxycarbonylamino group, $R_3$ represents a halogen atom, an alkoxy group, m is an integer of 0 to 5, n is an integer of 0 to 4.

2. The silver halide photographic light-sensitive material of claim 1, wherein at least one of silver halide emulsion layers contains at least one of spectral sensitizing dyes represented by Formula S-I, Formula S-I

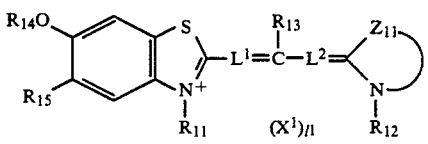

wherein $R_{11}$ and $R_{12}$ each represents an alkyl group having carbon numbers being within the range of 1 to 10, an alkenyl group, $R_{13}$ represents a hydrogen atom, a heterocyclic group, an aryl group, an alkyl group, $R_{14}$ and $R_{15}$ each represent an alkyl group, $Z_{11}$ represents nonmetallic atoms necessary for forming 5-membered monocyclic or condensed 5-membered nitrogen-containing heterocycle, $L^1$ and $L^2$ each represent a methine group, $R_{11}$ and $L^1$ or $R_{12}$ and $L^2$ may each joined to form 5-membered or 6-membered heterocycle, $X^1$ represents an ion cancelling electric charges inside molecules, $l^1$ represents the number of ions necessary for cancelling electric charges inside molecules; when the compound represented by Formula S-I forms an intramolecular salt, $l^1$ is 0.

3. The silver halide photographic light-sensitive material of claim 1, wherein the dye having absorption maximum at 590 nm to 610 nm is a compound selected from the group consisting of Formula 1, Formula 2, Formula 3, Formula 4, Formula 5, Formula 6, Formula 7, Formula 8 and Formula 9;

Formula 1
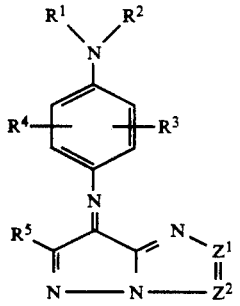
Formula 2
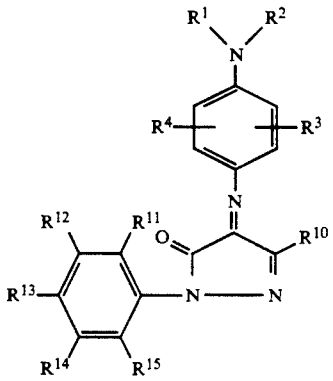
Formula 3
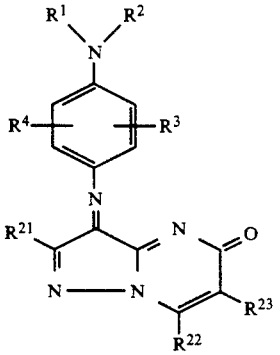
Formula 4
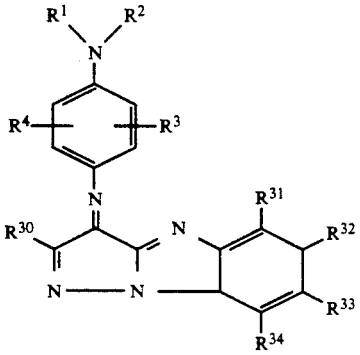
-continued
Formula 5
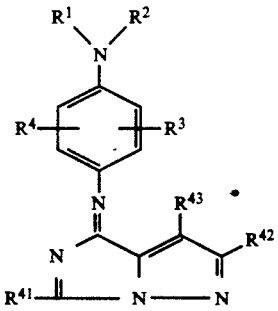
Formula 6
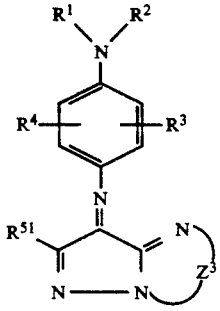
Formula 7
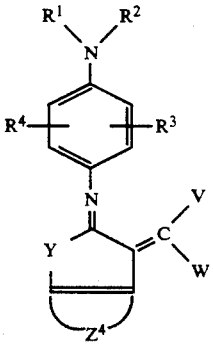
Formula 8
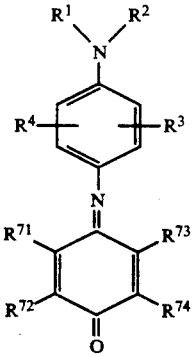
Formula 9
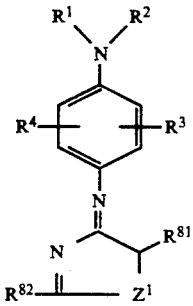

wherein $R^1$ and $R^2$ represent a hydrogen atom, an alkyl group, $R^3$ and $R^4$ represent a hydrogen atom, an alkyl group, $Z^1$ and $Z^2$ represent a nitrogen atom, a $=C(R^6)-$ group, $Z^3$ represents a non-metallic atom group necessary for forming a nitrogen-containing 7-membered heterocycle which may have a substituent, $Z^4$ represents non-metallic atoms necessary for forming a condensed benzene ring, $R^5$, $R^6$, $R^{11}$ to $R^{15}$, $R^{21}$ to $R^{23}$, $R^{31}$ to $R^{34}$, $R^{41}$ to $R^{43}$, $R^{51}$ and $R^{71}$ to $R^{74}$ each represent a hydrogen atom, a substituent, $R^{10}$ and $R^{30}$ represent a carbamoyl group, an alkoxycarbonyl group, an ureido group, an anilino group, a cyano group, $R^{81}$ represents an aryl group, $R^{82}$ represents an aryl group, an alkoxyl group, an aryloxy group, a heterocyclic group, an alkylthio group, an arylthio group, a heterocyclic group, a 1-pyrazole group, $R^{73}$ and $R^{74}$ may be together joined to form a condensed ring, Y represents a carbonyl group, a thiocarbonyl group, a sulfur atom, a sulfinyl group, a sulfonyl group, a —N(Ra)— group, —P(Ra)— group, V and W each represent a group having 0.4 to 2.0 of $\sigma_p$ value, Ra represents a hydrogen atom, an alkyl group, an aryl group, a heterocyclic group.

4. A silver halide color photographic light-sensitive material comprising a support having thereon a blue-sensitive silver halide emulsion layer, a green-sensitive silver halide emulsion layer and a red-sensitive silver halide emulsion layer, wherein at least one of green-sensitive silver halide emulsion layers contains at least one of colored magenta couplers represented by Formula CM-1 and at least one of silver halide emulsion layers contains at least one of spectral sensitizing dyes represented by Formula S-I and at least one of layers selected from the layers consisting of silver halide emulsion layers and photographic constitution layers contains at least one of dyes having absorption maximum at 590 nm to 610 nm selected from the dyes consisting of Formula 1, Formula 2, Formula 3, Formula 4, Formula 5, Formula 6, Formula 7, Formula 8 and Formula 9;

Formula CM-1

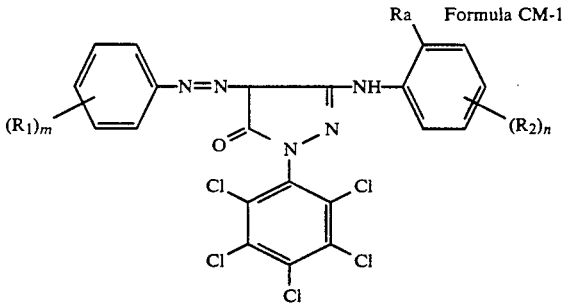

wherein $R_1$ represents a substituent, $R_2$ represents an acylamino group, a sulfonamide group, an imide group, a carbamoyl group, a sulfamoyl group, an alkoxyl group, an alkoxycarbonyl group, an alkoxycarbonylamino group, $R_3$ represents a halogen atom, an alkoxy group, m is an integer of 0 to 5, n is an integer of 0 to 4, Formula S-I

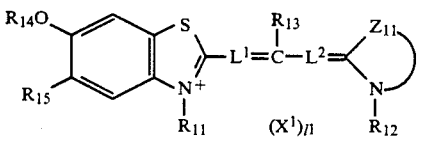

wherein $R_{11}$ and $R_{12}$ each represents an alkyl group having carbon numbers being within the range of 1 to 10, an alkenyl group, $R_{13}$ represents a hydrogen atom, a heterocyclic group, an aryl group, an alkyl group, $R_{14}$ and $R_{15}$ each represent an alkyl group, $Z_{11}$ represents nonmetallic atoms necessary for forming 5-membered monocyclic or condensed 5-membered nitrogen-containing heterocycle, $L^1$ and $L^2$ each represent a methine group, $R_{11}$ and $L^1$ or $R_{12}$ and $L^2$ may each joined to form 5-membered or 6-membered heterocycle, $X^1$ represents an ion cancelling electric charges inside molecules, $l^1$ represents the number of ions necessary for cancelling electric charges inside molecules; when the compound represented by Formula S-I forms an intramolecular salt, $l^1$ is 0, Formula 1

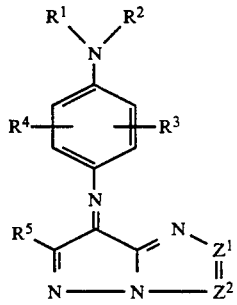

Formula 2

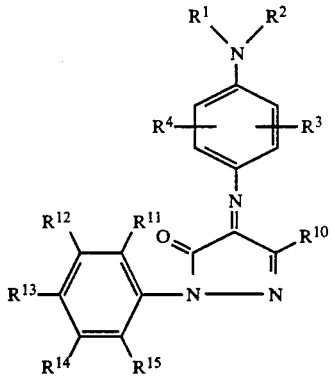

Formula 3

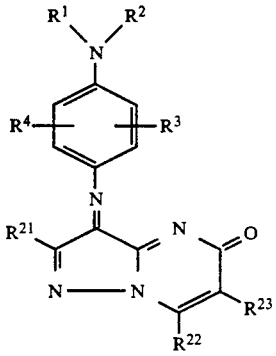

-continued

Formula 4

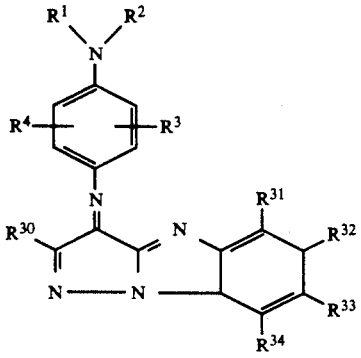

Formula 5

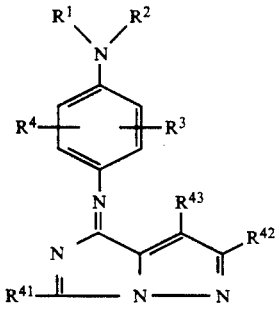

Formula 6

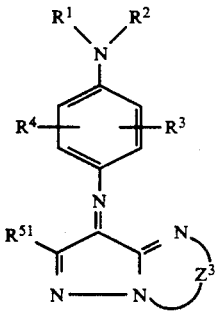

-continued

Formula 7

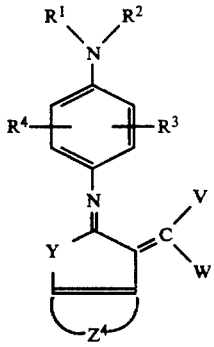

Formula 8

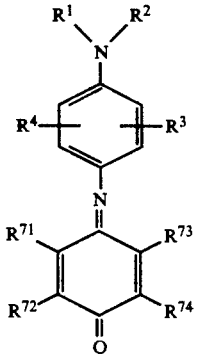

Formula 9

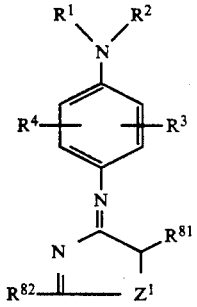

wherein $R^1$ and $R^2$ represent a hydrogen atom, an alkyl group, $R^3$ and $R^4$ represent a hydrogen atom, an alkyl group, $Z^1$ and $Z^2$ represent a nitrogen atom, a $=C(R^6)-$ group, $Z^3$ represents a non-metallic atom group necessary for forming a nitrogen-containing 7-membered heterocycle which may have a substituent, $Z^4$ represents non-metallic atoms necessary for forming a condensed benzene ring, $R^5$, $R^6$, $R^{11}$ to $R^{15}$, $R^{21}$ to $R^{23}$, $R^{31}$ to $R^{34}$, $R^{41}$ to $R^{43}$, $R^{51}$ and $R^{71}$ to $R^{74}$ each represent a hydrogen atom, a substituent, $R^{10}$ and $R^{30}$ represent a carbamoyl group, an alkoxycarbonyl group, an ureido group, an anilino group, a cyano group, $R^{81}$ represents an aryl group, $R^{82}$ represents an aryl group, an alkoxyl group, an aryloxy group, a heterocyclic group, an alkylthio group, an arylthio group, a heterocyclic group, a 1-pyrazole group, $R^{73}$ and $R^{74}$ may be together joined to form a condensed ring, Y represents a carbonyl group, a thiocarbonyl group, a sulfur atom, a sulfinyl group, a sulfonyl group, a —N(Ra)— group, —P(Ra)— group, V and W each represent a group having 0.4 to 2.0 of $\sigma_p$ value, Ra represents a hydrogen atom, an alkyl group, an aryl group, a heterocyclic group.

* * * * *

UNITED STATES PATENT AND TRADEMARK OFFICE

CERTIFICATE OF CORRECTION

PATENT NO. : 5,238,797

DATED : August 24, 1993

INVENTOR(S) : Shigeto Hirabayashi et al

It is certified that error appears in the above-indentified patent and that said Letters Patent is hereby corrected as shown below:

Claim 2, column 68, line 56, before "joined" insert --be--.

Claim 3, column 69, in Formula 2 change

" 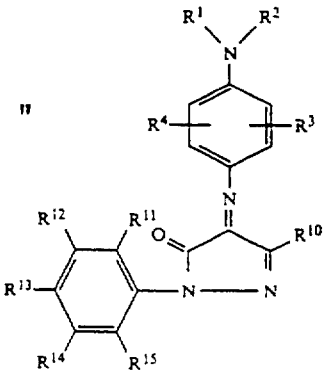 Formula 2 " to -- 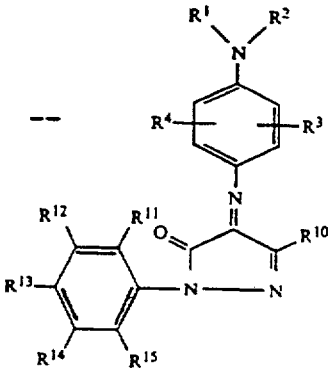 Formula 2 --.

Signed and Sealed this

Ninth Day of May, 1995

Bruce Lehman

BRUCE LEHMAN

*Commissioner of Patents and Trademarks*

*Attest:*

*Attesting Officer*